US007076983B2

(12) United States Patent
Chikushi et al.

(10) Patent No.: US 7,076,983 B2
(45) Date of Patent: Jul. 18, 2006

(54) APPARATUS AND METHOD FOR HOT ROLLING

(75) Inventors: Ichiro Chikushi, Kawanishi (JP); Ryuro Kurahashi, Amagasaki (JP); Toshiharu Morimoto, Osaka (JP); Takashi Ohtani, Osaka (JP); Kazuaki Hakomori, Kobe (JP); Shinji Takaoka, Kobe (JP); Masanori Takahashi, Kobe (JP); Akio Adachi, Akashi (JP)

(73) Assignees: Nakayama Steel Works, Ltd., Osaka (JP); Kawasaki Jukogyo Kabushiki Kaisha, Kobe (JP)

( * ) Notice: Subject to any disclaimer, the term of this patent is extended or adjusted under 35 U.S.C. 154(b) by 97 days.

(21) Appl. No.: 10/220,728

(22) PCT Filed: Jan. 29, 2002

(86) PCT No.: PCT/JP02/00667

§ 371 (c)(1),
(2), (4) Date: Sep. 4, 2002

(87) PCT Pub. No.: WO02/074460

PCT Pub. Date: Sep. 26, 2002

(65) Prior Publication Data

US 2003/0168137 A1 Sep. 11, 2003

(30) Foreign Application Priority Data

Mar. 16, 2001 (JP) ..... 2001-077293
Sep. 20, 2001 (JP) ..... 2001-287427
Sep. 20, 2001 (JP) ..... 2001-287428

(51) Int. Cl.
*B21B 1/04* (2006.01)

(52) U.S. Cl. ..... 72/201; 72/234

(58) Field of Classification Search ..... 72/201, 72/234
See application file for complete search history.

(56) References Cited

U.S. PATENT DOCUMENTS 3,861,188 A * 1/1975 Kamit et al. ..... 72/234
4,379,396 A * 4/1983 Hope et al. ..... 72/8.5
5,186,018 A * 2/1993 van Ditzhuijzen et al. ... 62/374
5,636,543 A * 6/1997 Kajiwara et al. ..... 72/234

(Continued)

FOREIGN PATENT DOCUMENTS

JP 56-126907 2/1980

(Continued)

OTHER PUBLICATIONS

Toshiyuki Kajiwara et al., "The UC Mill and Roll Shift Technology", Steel Technology International (1990/91), pp. 5,7,9,11,219-221 and 223.

*Primary Examiner*—Lowell A. Larson
(74) *Attorney, Agent, or Firm*—Oliff & Berridge, PLC

(57) ABSTRACT

The hot rolling apparatus of the present invention has a mill arranged on the preceding stage, mills of a plurality of stands arranged on the later stage which are different-diameter roll mills including a pair of different-diameter work rolls having an equivalent roll diameter of less than 600 mm or minimum-diameter roll mills including a pair of work rolls having a diameter of less than 600 mm, and a cooling unit for cooling steel to be rolled which is arranged on each exit side of the mills of at least two stands on the later stage. The hot rolling apparatus can smoothly manufacture hot rolled plates of fine-particle steel.

10 Claims, 18 Drawing Sheets

U.S. PATENT DOCUMENTS 6,062,055 A * 5/2000 Bobig et al. ..... 72/201

FOREIGN PATENT DOCUMENTS

| | | | | |
|---|---|---|---|---|
| JP | A 58-123823 | | 7/1983 | |
| JP | 61-20615 | * | 1/1986 | ..... 72/201 |
| JP | A 4-94802 | | 3/1992 | |
| JP | B2 5-65564 | | 9/1993 | |
| JP | A 6-320202 | | 11/1994 | |
| JP | A 10-53812 | | 2/1998 | |
| JP | A 10-180338 | | 7/1998 | |
| JP | A 11-71615 | | 3/1999 | |
| JP | A 11-77102 | | 3/1999 | |
| JP | A 2000-84601 | | 3/2000 | |
| JP | A 2000-84611 | | 3/2000 | |
| JP | A 2000-197909 | | 7/2000 | |

* cited by examiner

10 μm

10 μm

APPARATUS AND METHOD FOR HOT ROLLING

TECHNICAL FIELD

The present invention relates to a hot rolling apparatus and a hot rolling method and more particularly to a hot rolling apparatus and a hot rolling method for manufacturing a steel plate having a micro-structure mainly composed of fine ferrite.

BACKGROUND ART

Generally, as a means for improving the mechanical properties of rolled steel, refinement of the structure of rolled steel is well known. Improvement of the mechanical properties of rolled steel provides many advantages such as realization of lightweight of a steel structure. Many methods for manufacturing steel having a micro-structure, that is, fine-particle steel have been proposed and as typical methods, (1) the high-pressure rolling method and (2) the control rolling method may be cited.

Among them, (1) the high-pressure rolling method is described in Japanese Patent Laid-Open Publication No. 123823/1983 and Japanese Patent Publication 65564/1993. Namely, the method applies high pressure to austenite particles, thereby promotes the straining transformation from the austenite (γ) phase to the ferrite (α) phase, and refines the structure.

Further, (2) the control rolling method is a method for realizing refinement of ferrite particles containing components of Nb (niobium) and Ti (titanium) which can be easily increased in tension by the deposition increasing operation of Nb and Ti and also promotes the straining transformation from they phase to the a phase when the cold rolling (ferrite region rolling) is executed by the recrystallization suppression operation for austenite particles of Nb and Ti.

The control rolling method executes the finishing rolling in the low temperature zone (800° C. or less), so that it has a disadvantage that the deformation resistance of steel to be rolled is extremely high, thus the load on the strip rolling apparatus is large. On the other hand, the high-pressure rolling method, as indicated in Japanese Patent Publication 65564/1993 aforementioned, cannot be executed industrially by a general hot strip mill and requires use of a special rolling apparatus. The reason is that, as described in the aforementioned patent publications, continuous rolling at a high pressurization rate (for example, 40% or more) which cannot be realized by a general rolling apparatus is required.

When fine-particle steel is to be manufactured industrially and commercially by executing the high-pressure rolling method, in addition to that a rolling apparatus of a general hot strip mill type cannot be used, the following problems are imposed.

i) Owing to execution of rolling under high pressure, that is, at a high pressurization rate, faults due to the rolling load may be often caused. Namely, there is a case that the rolling load reaches the intrinsic limit value (mill power restriction and machine strength) of the rolling apparatus and rolling becomes impossible. Furthermore, for steel to be rolled, a predetermined pressurization rate cannot be realized and large edge drops are caused. The reason that the predetermined pressurization rate cannot be obtained is that particularly when the plate thickness on the exit side of the rolling apparatus is 2 mm or less and the pressurization rate is 40% or more, the rolling load is large and the deformation resistance is high, so that the rolling flatness is increased. In this case, even if the pressure is increased so as to execute rolling under high pressure, the pressurization rate is not increased. The reason for increasing the edge drop is that a high load is applied to the neighborhood of the edge (the end in the width direction) of steel to be rolled and no good plate profile can be obtained.

ii) Difficulty in keeping the temperature of steel to be rolled is also a serious problem. The reason is that when rolling is executed at a high pressurization rate using a mill of a plurality of stands, the temperature of steel to be rolled is increased remarkably due to working heat generation and it is not easy to keep it at the temperature (the range from the transformation point of $Ar_3$ to $Ar_3$+50° C.) suited to execution of the high-pressure rolling method. When steel to be rolled is accelerated and the feed speed is increased, the strain speed is increased and the working heat generation is increased, so that it becomes difficult more and more to keep the temperature.

iii) Faults relating to the thermal load of the rolls are often caused. When rolling at a high load providing a high pressurization rate is executed, the working heat generation of steel to be rolled is also increased and the thermal load of the rolls is increased in correspondence to it. As a result, a thermal crown that each roll is extended in diameter at the center thereof is easily generated. The thermal crown may not be eliminated only by cooling each roll depending on the degree thereof, and steel to be rolled gets worse in the shape, and a stable flow of plate may not be obtained easily.

iv) The rolls are worn out strongly and the shape (crown) of steel to be rolled easily gets worse. The reason is that during rolling at a high pressurization rate and a high load, the thermal or dynamic load applied on the rolls is high, so that the wear of the rolls easily progresses. At the part of each roll in contact with the edge of steel to be rolled, the rolling load is high, so that the wear easily progresses and the profile of steel to be rolled which is important for the quality thereof is easily reduced greatly. Further, when the rolls are easily worn out, the cost for maintenance such as grinding or exchange of the rolls is increased.

Therefore, an object of the present invention is to solve the aforementioned problems concerning manufacture of hot rolled steel plates of fine-particle steel by providing a hot rolling apparatus for enabling smooth manufacture of those steel plates and a fine-particle steel manufacturing method.

Further, another object of the present invention is to provide a continuous hot rolling method suited to manufacture of hot rolled steel plates of fine-particle steel which is superior in respect of cost to effect.

Further, still another object of the present invention is to provide a continuous hot rolling method for smooth manufacture of thick plates using a hot rolling apparatus capable of manufacturing thin plates.

DISCLOSURE OF INVENTION

The present invention is a hot rolling apparatus for rolling a steel to be rolled to manufacture a steel plate, comprising: a mill arranged on the preceding stage, mills of a plurality of stands arranged on the later stage, said mills of plurality of stands comprising different-diameter roll mills including a pair of different-diameter work rolls having an equivalent roll diameter of less than 600 mm or minimum-diameter roll mills including a pair of work rolls having a diameter of less than 600 mm, and a cooling unit for cooling the steel to be rolled which is arranged on the exit side of the mill of at least one stand on the later stage.

Here, the "equivalent roll diameter" is referred to as a mean value of the diameters of the upper and lower paired different-diameter work rolls regarding the different-diameter roll mill.

Further, the cooling unit is preferably a curtain-wall type cooler.

Here, the "curtain-wall type cooler" is referred to as a cooling unit of a type such as to let a large mount of cooling water flow in a laminar flow state by putting in a row from above and underneath like a curtain and hit it against the top and bottom of steel to be rolled overall the width.

Further, among the mills arranged on the preceding stage and later stage, at least the mill arranged on the preceding stage preferably includes CVC mills of a plurality of stands.

Here, the "CVC mill" is referred to as a mill including a CVC roll which has an outer diameter continuously changed in the long axial direction and can move in the long axial direction.

Further, the equivalent roll diameter of the pair of different-diameter work rolls of the different-diameter roll mills or the roll diameter of the work rolls of the minimum-diameter roll mills is preferably 550 mm or less.

Further, the work rolls of the different-diameter roll mills or the work rolls of the minimum-diameter roll mills are provided with a CVC function and a bending function.

Here, the "CVC function" is referred to as a function for a roll having an outer diameter continuously changed in the long axial direction to move in the long axial direction and change and control the roll gap shape. Further, the "bending function" is referred to as a function for operating the bending force (bending moment) on the rolls and changing the roll gap shape.

Further, the hot rolling apparatus preferably has a lubricant feed unit for feeding a lubricant onto the roll surfaces of the mills additionally which is installed on the mill of at least any one stand among the mills arranged on the preceding stage and later stage.

Further, the lubricant feed unit preferably feeds a lubricant containing a fine-particle solid lubricant in grease.

Further, the hot rolling apparatus preferably has a fluid jet spray additionally for jetting a fluid to the steel to be rolled and removing cooling water existing on the steel to be rolled, which is arranged on the downstream side of the cooling unit in the flow direction of the steel to be rolled on the exit side of the mill of the stand on the last stage.

Further, the fluid jet spray preferably includes a plurality of nozzles for blowing out pressurized water so as to spread in the width direction of the steel to be rolled slantwise downward from above the steel to be rolled toward the upstream side in the flow direction of the steel to be rolled for the steel to be rolled.

The present invention is a method for rolling a steel to be rolled to manufacture a fine-particle steel, wherein the method feeds the heated steel to be rolled to a strip rolling apparatus having a mill arranged on the preceding stage and a mill arranged on the later stage, and the mill arranged on the later stage of the rolling apparatus has work rolls with a diameter of 550 mm or less, and the method cools the steel to be rolled before and after the mill arranged on the later stage of the rolling apparatus in the flow direction of the steel to be rolled and rolls the steel to be rolled so that the cumulative strain becomes 0.9 or more.

Here, the "strain" is referred to as the value indicated below, which is obtained by dividing the difference between the thickness ho of the steel to be rolled on the entrance side of each mill and the thickness $h_1$ on the exit side by the mean thickness of the two.

$$\epsilon=(h_0-h_1)/\{(h_0+h_1)/2\}$$

Further, the "cumulative strain" is the strains at the respective mills (the mills of the stands on the upstream side thereof are ignored because the effect thereof is small) of a plurality of stands (for example, 3 stands or 2 stands) on the later stage which are added and totalized in consideration of the effect intensity on the metallic structure and assuming the strains at the stand on the last stage, the stand before it, and the stand before it as $\epsilon_n$, $\epsilon_{n-1}$, and $\epsilon_{n-2}$, it is expressed as follows $$\epsilon_c=\epsilon_n+\epsilon_{n-1}/2+\epsilon_{n-2}/4$$

The fine-particle steel manufacturing method of the present invention rolls the steel to be rolled using any of the aforementioned hot rolling apparatuses so that the cumulative strain of the steel to be rolled on the later stage of the rolling apparatus becomes 0.9 or more.

Further, the steel to be rolled immediately after it leaves the mill of the last stand is preferably cooled at a temperature lowering rate per second of 20° C. or more.

Further, the steel P to be rolled referably has a carbon content of 0.5% or less and an alloy element content of 5% or less.

The method of the present invention for continuously hot-rolling a steel to be rolled to manufacture a steel plate feeds the heated steel to be rolled to a rolling apparatus having mills of a plurality of stands arranged tandem on the preceding and later stages, rolls the steel to be rolled using the rolling apparatus so that the cumulative strain of the steel to be rolled becomes 0.6 or more, and cools the steel to be rolled on each exit side of the mills of one stand or more on the later stage of the rolling apparatus.

Further, the rolling end temperature of the steel to be rolled is preferably set within the range from the $Ar_3$ transformation point −50° C. or higher to the $Ar_3$ transformation point +50° C. or lower.

Here, the "rolling end temperature" is the surface temperature of the steel to be rolled measured by a thermometer installed on the downstream side (the downstream side of the arranged last stage of mill by several m) of the rolling apparatus in the flow direction of the steel to be rolled.

Further, the mean ferrite particle diameter inside steel plates obtained by rolling the steel to be rolled is preferably about 3 to 7 μm.

The continuous hot rolling method of the present invention for rolling a steel to be rolled to manufacture a thick plate feeds the heated steel to be rolled to a rolling apparatus having mills of a plurality of stands arranged tandem on the preceding and later stages so as to roll the steel to be rolled and manufacture a thin plate, without using at least one part of the plurality of mills arranged on the later stage of the rolling apparatus and by use of the mills of at least 3 stands close to the entrance side of the rolling apparatus, rolls the steel to be rolled so that the cumulative strain of the steel to be rolled becomes 0.25 or more or the pressurization rate at the mill on the last stage among the mills provided for use becomes 12% or more, and cools the steel to be rolled on the exit side of the mill on the last stage provided for use.

Here, the "thin plate" is referred to as a steel plate with a thickness of less than 6 mm and the "thick plate" is referred to as a steel plate with a thickness of 6 mm or more (less than about 50 mm).

Further, the rolling end temperature of the steel to be rolled is preferably set to the $Ar_3$ transformation point +50° C. or less.

Here, the "rolling end temperature" is the surface temperature of the steel to be rolled measured by a thermometer installed on the downstream side (the downstream side of the arranged last stage of mill by several m) of the rolling apparatus in the flow direction of the steel to be rolled.

Further, the mean ferrite particle diameter inside the surface of the thick plates obtained by rolling the steel to be rolled by ¼ of the thickness thereof is preferably about 3 to 10 μm.

BEST MODE FOR CARRYING OUT THE INVENTION

A hot rolling apparatus of an embodiment of the present invention and a fine-particle steel manufacturing method using the hot rolling apparatus will be explained hereunder with reference to the accompanying drawings.

Figure 1:
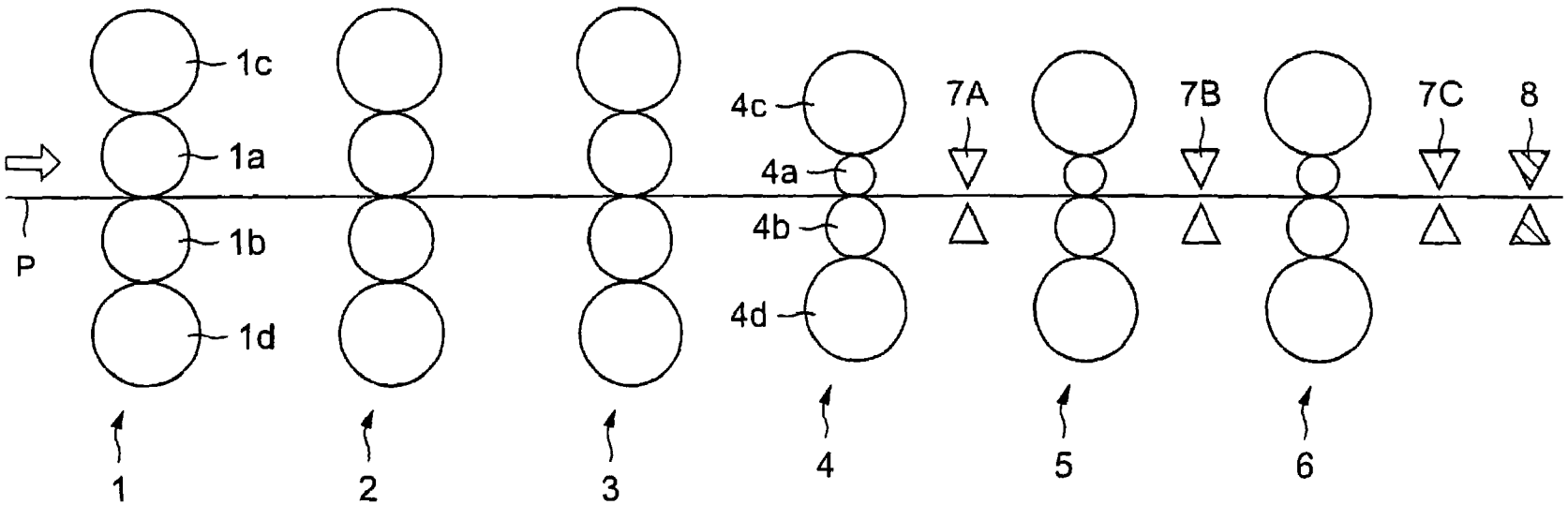
FIG. 1 is a side view conceptually showing the whole arrangement of a hot rolling apparatus of an embodiment of the present invention.

The hot rolling apparatus of this embodiment shown in FIG. 1 is a finishing rolling apparatus, and on the upstream side (not shown in the drawing) in the flow direction of steel P to be rolled, a heating furnace and a rough rolling apparatus are installed, and on the downstream side (not shown in the drawing), a run-out table and a winder are arranged. The hot rolling apparatus is structured as indicated below so as to continuously roll the steel P to be rolled roughly rolled on the upstream side, thereby manufacture hot rolled steel plates of fine-particle steel having a fine ferrite structure.

Figure 2A:
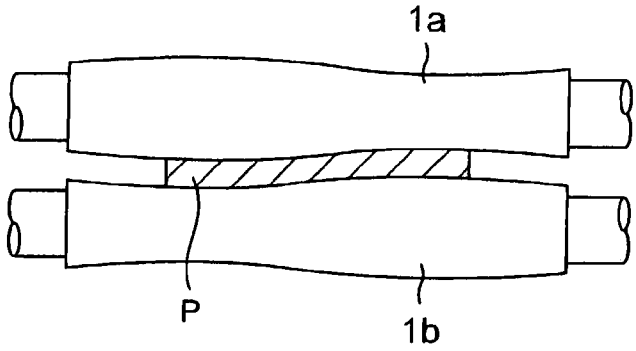
FIGS. 2A, 2B, and 2C are schematic views for explaining the CVC function regarding the mill 1 on the preceding stage in the rolling apparatus shown in FIG. 1.
Figure 2B:
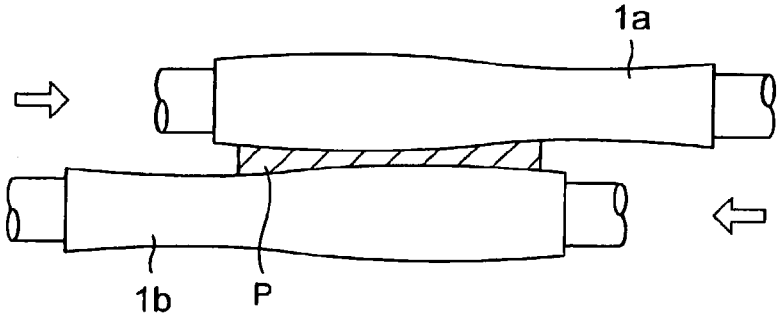
Figure 2C:
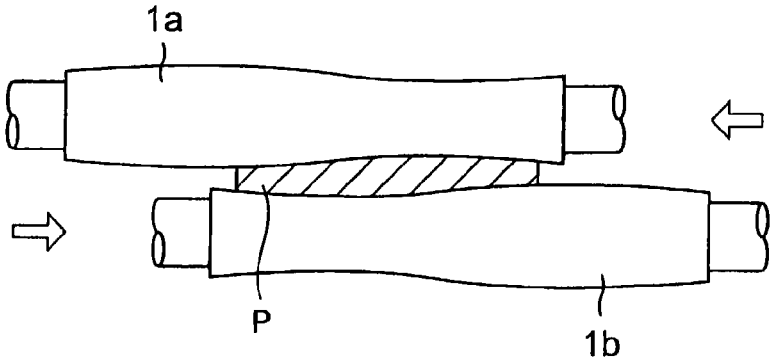

Firstly, as mills of 3 stands constituting the preceding stage of the hot rolling apparatus, so-called CVC mills 1, 2, and 3 are arranged tandem. The CVC mill 1 positioned closest to the entrance side of the hot rolling apparatus is structured as a quadrupole mill composed of work rolls 1*a* and 1*b* and backup rolls 1*c* and 1*d* as shown in FIG. 1 and the work rolls 1*a* and 1*b* have crowns (CVC, that is, continuous diameter changes) as shown in FIG. 2A. The work rolls 1*a* and 1*b*, as shown in FIGS. 2B and 2C, can move (shift) in the long axial directions opposite to each other at the same time, thus the position relationship between the rolls, that is, the roll gap can be adjusted. The diameter of the work rolls 1*a* and 1*b* is set to 700 mm and the maximum shift amount is set to 100 mm in both forward and backward directions. The CVC mills 2 and 3 of the other two stands are not different from the CVC mill 1 in the constitution and function.

The reason that the CVC mills 1, 2, and 3 are arranged on the preceding stage like this is that the crown (shape) of the steel P to be rolled is to be kept suitably. In different-diameter roll mills 4, 5, and 6 (described later) on the later stage, thermal crowns caused by working heat generation due to rolling are easily formed, so that plate crowns are corrected beforehand by the CVC mills 1, 2, and 3 installed on the preceding stage and the medium drawing of the steel P to be rolled is reduced.

Namely, the CVC mills 1, 2, and 3 have a large changing capacity of the roll gap shape compared with the means of simply executing roll bending and are arranged around the part of the preceding stage where steel to be rolled is thick and the crown control can be easily executed, so that it is advantageous in prevention of non-stabilization of plate flowing on the later stage where crowns are adjusted and large pressure is applied.

Further, the hot rolling apparatus of this embodiment, as mills of 3 stands constituting the later stage following the preceding stage, has the so-called different-diameter roll mills 4, 5, and 6 arranged tandem. The stand intervals of all the 6 stands including the CVC mills 1, 2, and 3 aforementioned are all equal such as 5.5 m. The different-diameter roll mill 4 corresponding to the 4th stand counted from the CVC mill 1 is structured as a quadrupole mill composed of work rolls 4*a* and 4*b* and backup rolls 4*c* and 4*d* as shown in FIG. 1 and the work rolls 4*a* and 4*b* have different diameters as shown in the drawing.

And, among the work rolls 4*a* and 4*b*, only the lower roll 4*b* with a large diameter is driven to rotate by a motor (not shown in the drawing) and the upper roll 4*a* with a small diameter is structured so as to freely rotate free of driving force. The work rolls 4*a* and 4*b* are respectively provided with a bender (not shown in the drawing), so that the work rolls 4*a* and 4*b* can be provided with bending. Further, the work rolls 4*a* and 4*b* are given the CVC function and can be moved forward and backward in the long axial direction within a range of 100 mm.

Since the work rolls 4*a* and 4*b* are given the bending function and CVC function like this, the shape control capacity for steel to be rolled is improved and a good profile of steel plates can be obtained.

The diameter of the work roll 4*a* is 480 mm, and the diameter of the work roll 4*b* is 600 mm, and the equivalent roll diameter which is a mean value of the two is 540 mm. In the constitution and function aforementioned, the different-diameter roll mills 5 and 6 of the other 2 stands positioned behind are not different from the different-diameter roll mill 4. Further, although the equivalent roll diameter of the work rolls of the different-diameter roll mills 4, 5, and 6 can be made smaller than 540 mm, it is preferably 400 mm or more from the viewpoint of strength.

The equivalent roll diameter is small and since only one work roll (4*b*, etc.) is driven, shearing force operates on the steel P to be rolled, so that the different-diameter roll mills 4, 5, and 6 of 3 stands can execute rolling at a high pressurization rate (for example, a pressurization rate of 50%) even at a comparatively low rolling load. Therefore, high-pressure rolling for forming a fine ferrite structure in the steel P to be rolled can be executed at a small rolling load and moreover, since the rolling load is small, faults due to the roll flatness and edge drops are not caused.

Figure 6:
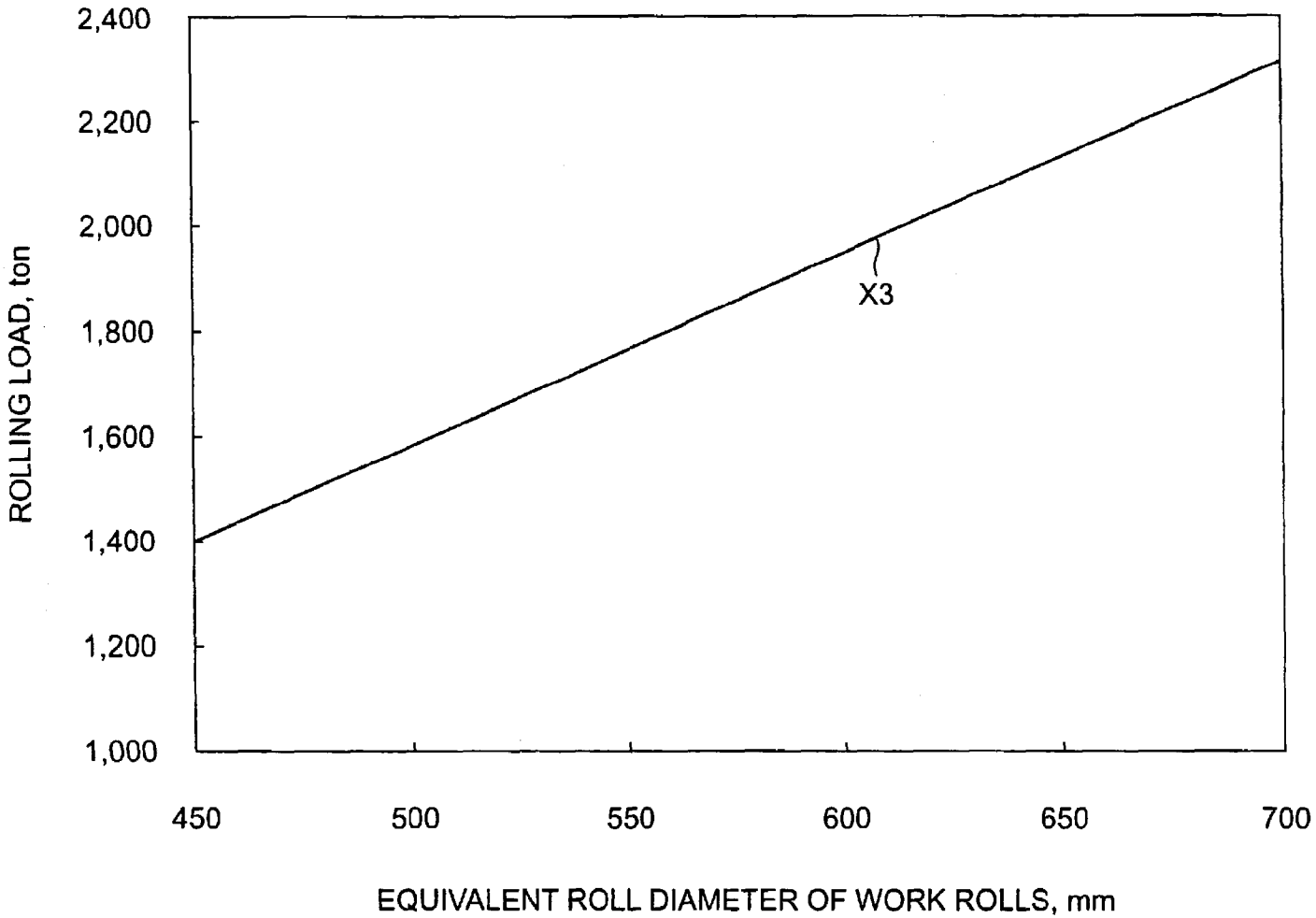
FIG. 6 is a chart showing the relation between the equivalent diameter of a work roll of a different-diameter roll mill and the rolling load.

The chart X3 shown in FIG. 6, when the different-diameter roll mill 6 of the 6th stand rolls and manufactures a steel plate (the components are C of 0.16%, Si of 0.22%, and Mn of 0.82%) with a thickness of 2.3 mm and a width of 730 mm at an equal pressurization rate (48%), shows a relationship between the equivalent diameter of the work rolls and the rolling load.

Figure 7:
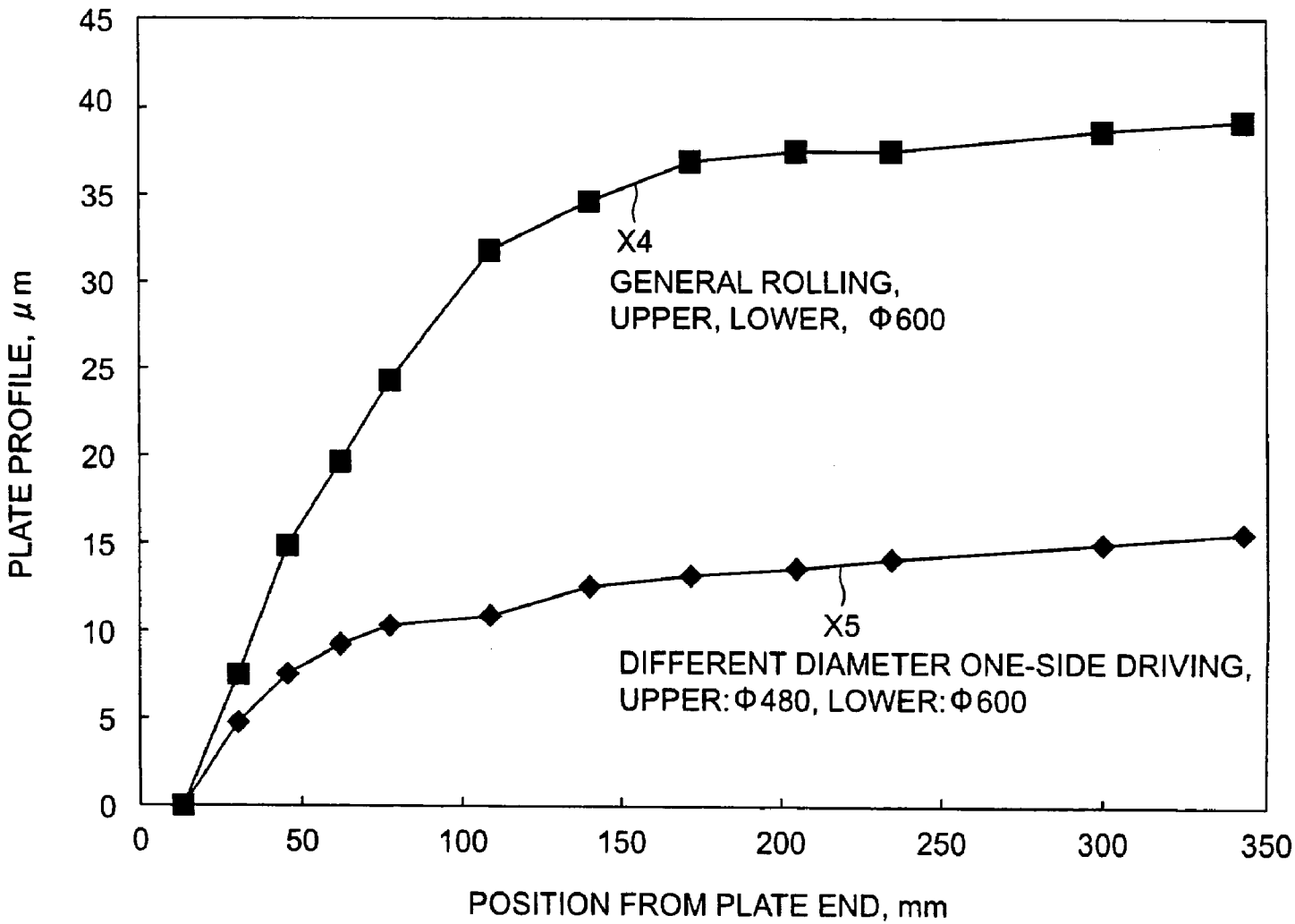
FIG. 7 is a chart showing the reduction effect of edge drops of a different-diameter roll mill.

Further, the chart X5 shown in FIG. 7 shows edge drops generated when the fixed different-diameter roll mills 5 and 6 (the diameters of the work rolls 5*a* and 6*a* are 480 mm, and those of the work rolls 5*b* and 6*b* are 600 mm, and the equivalent roll diameter of each mill is 540 mm) roll and manufacture the same steel plate as that shown in FIG. 6. Further, the chart X4 shown in FIG. 7 shows edge drops for comparison when the different diameters of the work rolls are made equal (a medium scale diameter of 600 mm) and the same steel plate is rolled and manufactured.

Figure 9:
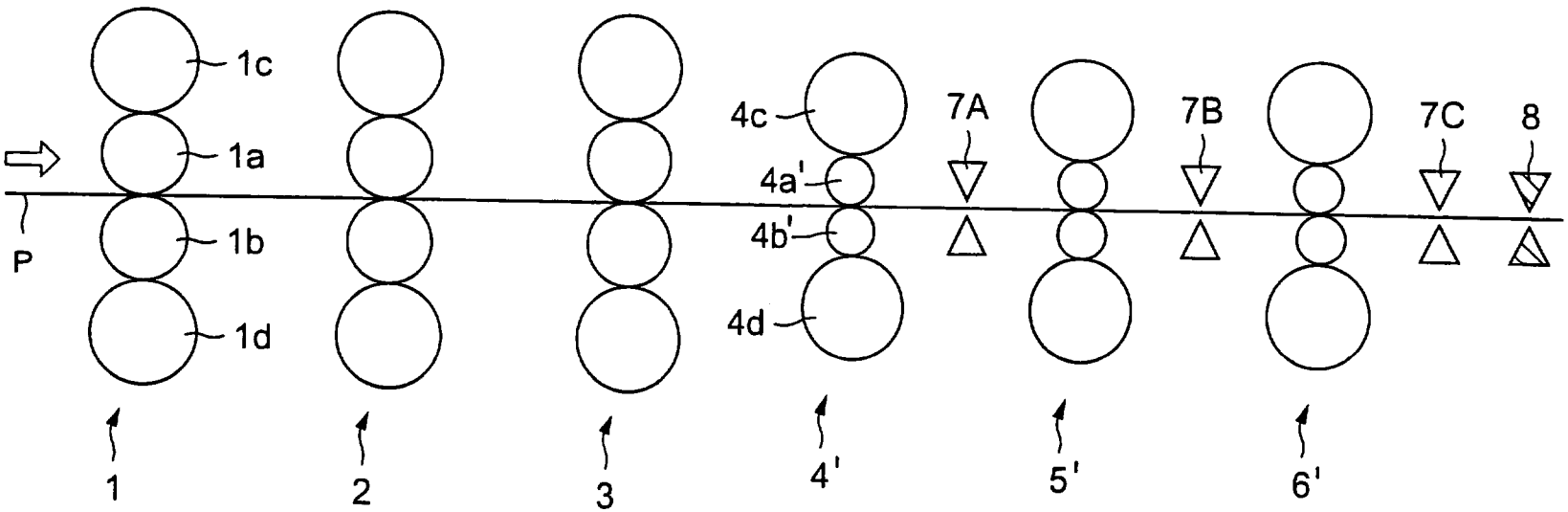
FIG. 9 is a side view conceptually showing the whole arrangement of a hot rolling apparatus of a varied example of the embodiment shown in FIG. 1.

Further, as a varied example of this embodiment, as shown in FIG. 9, the mills arranged on the later stage, in place of the different-diameter roll mills 4, 5, and 6, may be changed to minimum-diameter roll mills 4', 5', and 6' including a pair of work rolls 4*a'* and 4*b'* with a diameter of less than 600 mm.

Further, in the hot rolling apparatus of this embodiment, a lubricant feed unit is arranged for each work roll of the mills 1 to 6 of all the 6 stands. The unit is composed of, for example, injection ports directed toward the surface of each work roll such as numerals 5*e*, 5*f*, 6*e*, and 6*f* shown in FIG. 3 and lubricant feed pumps to them. Further, as a varied example, in place of direct feed of a lubricant to the surface of each work roll, a lubricant is fed to the surface of the steel P to be rolled, thereby indirectly fed to the roll surfaces.

Further, in the hot rolling apparatus of this embodiment, the lubricant is used to prevent each roll surface from wear and not used to lower the coefficient of friction. Therefore, as a lubricant, a fine-particle solid lubricant such as tribasic calcium phosphate, mica, or calcium carbonate included in grease is used. By blending those solid fine particles, the coefficient of friction μ between each work roll and the steel P to be rolled when a lubricant is used becomes rather higher such as about 0.28 or more. When such a degree of coefficient of friction is ensured, the steel P to be rolled is properly prevented from roll slip.

When the aforementioned lubricant is used, the aforementioned fine particles lie between each roll surface and the steel P to be rolled and the direct contact between the rolls and the steel P can be prevented, so that the wear of the roll surfaces is suppressed and the shape of the steel P can be easily kept satisfactorily for a long time. Further, solid fine particles are included in grease instead of mineral oil, so that there is an advantage that there is no possibility that fine particles may be precipitated in a storage container of a lubricant and the lubricant is fed so that solid fine particles are always dispersed uniformly on each roll surface.

Figure 8:
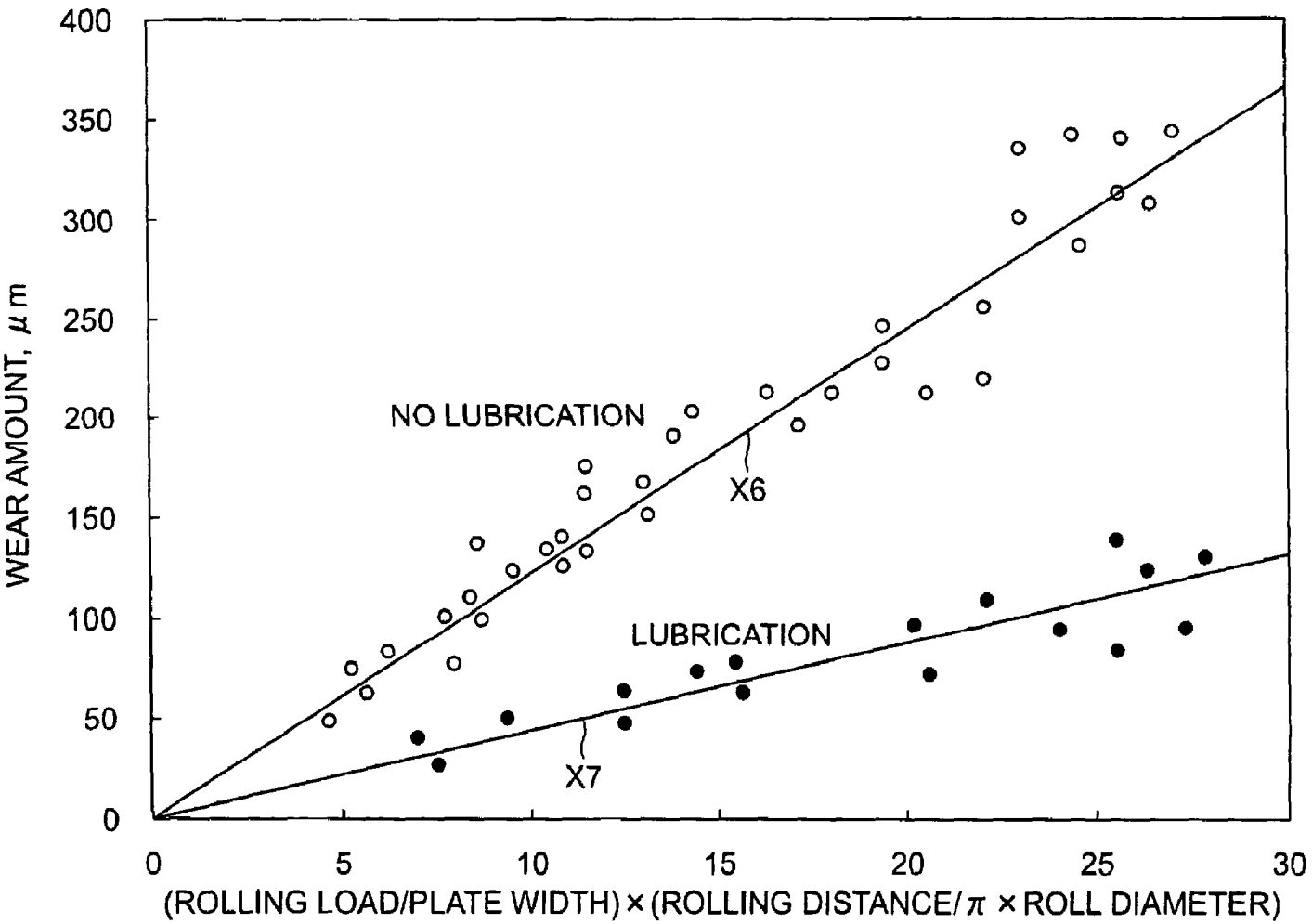
FIG. 8 is a chart showing the wear reduction effect of the roll surface when a lubricant is used.

FIG. 8 shows the roll wear reduction effect due to use of a lubricant, and the chart X6 indicates a case of no use of a lubricant, and the chart X7 indicates a case of use of a lubricant. Further, the transverse axis of FIG. 8 indicates the magnitude of load of work rolls and the ordinate axis indicates the wear amount of work rolls.

Figure 3:
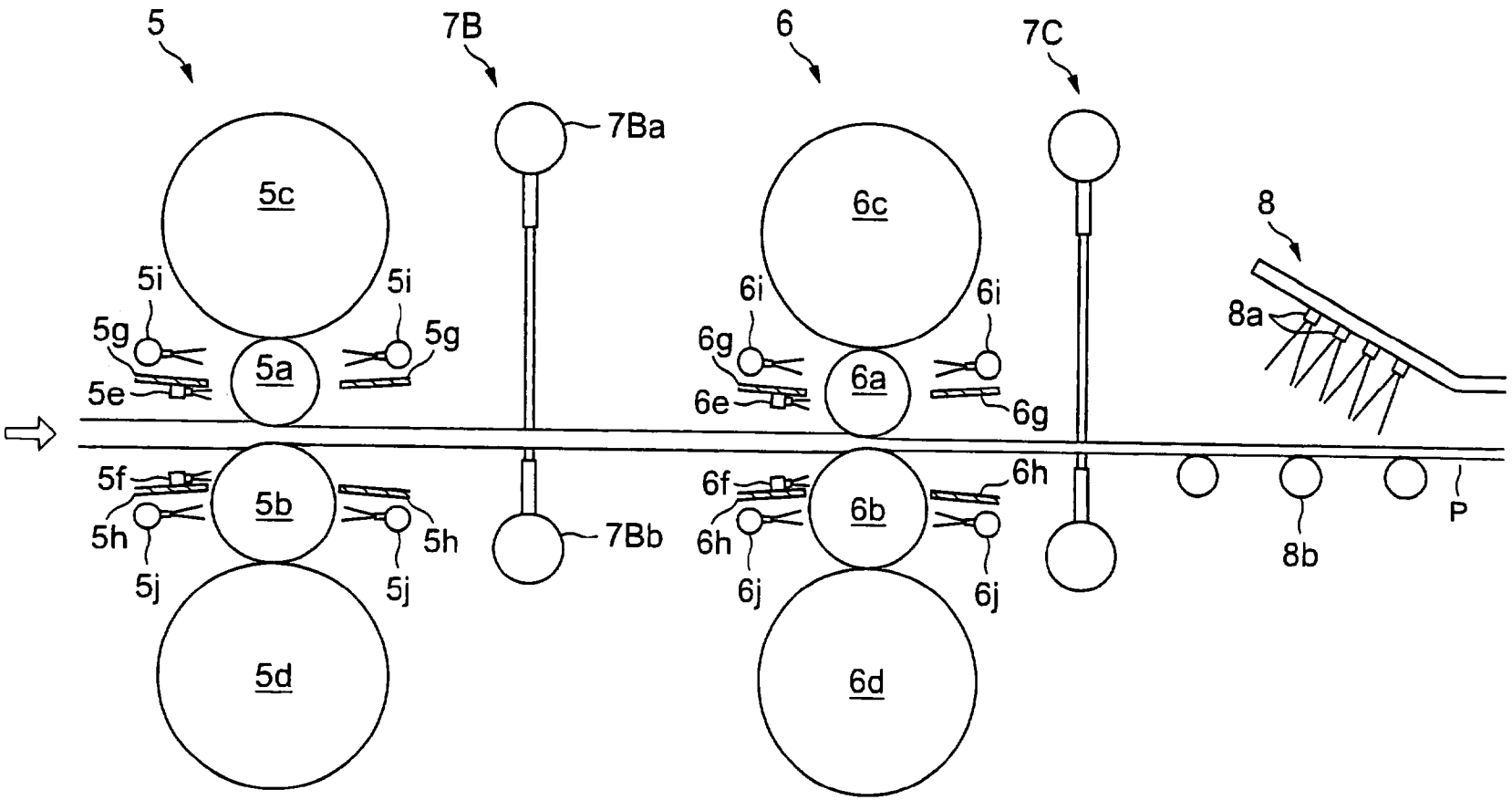
FIG. 3 is a side view showing the mill 6 on the last stage in the rolling apparatus shown in FIG. 1 in detail.

Further, in the hot rolling apparatus of this embodiment, on each exit side of the different-diameter roll mills 4, 5, and 6 of the 3 stands arranged on the later stage, curtain wall type coolers 7A, 7B, and 7C are arranged. The cooler 7B will be explained as an example. As shown in FIG. 3, the cooler 7B lets a large amount of cooling water at the normal temperature flow in a curtain shape (curtain wall state, with a thickness of 10 mm or more, a most suitable thickness of 16 mm) in a laminar flow state toward the full-width surface of the steel P to be rolled from upper and lower headers 7Ba and 7Bb, thereby strongly cools the steel P to be rolled. The amount of cooling water can be adjusted within the range from 100 to 500 $m^3$/h per unit width (1 m) of the steel P to be rolled and the temperature lowering speed of the steel P is 20° C./s or more. In the curtain wall type cooler, cooling water of 350 $m^3$/h per unit width is generally used. The temperature lowering rate of the steel P to be rolled in this case reaches 60 to 80° C./s (40° C./s or so including the raised temperature due to working heat generation) when the product of plate thickness and speed is 1200 mm·mpm. The other coolers 7A and 7C also have the same constitution and function.

Further, in the hot rolling apparatus of this embodiment, the curtain wall type coolers are arranged on the exit sides of the mills 4, 5, and 6 on the later stage. However, the number of coolers to be installed is not limited to it and can be properly changed depending on the kind of steel to be rolled.

By use of the curtain wall type coolers 7A, 7B, and 7C, the temperature rise of the steel P to be rolled due to working heat generation during rolling is suppressed, and the steel P to be rolled is kept within the temperature range suited to the high-pressure rolling method or control rolling method, and an occurrence of particle growth of the micro-structure after rolling can be suppressed.

Further, the run-out table (not shown in the drawing) on the downstream side of the hot rolling apparatus shown in FIG. 1 also cools the steel P to be rolled by cooling water at a speed of 10° C./s or more so as to prevent particle growth.

In the hot rolling apparatus shown in FIG. 1, on the exit side of the different-diameter roll mill 6 of the stand on the stand on the last stage, a water jet spray 8 is arranged away from the curtain wall type cooler 7C by several hundreds mm to 1 m. This is to remove cooling water put on the top of the steel P to be rolled by the cooler 7C. As shown in FIG. 3, the spray 8 has a plurality of nozzles 8*a* (4 each in total in this example) for respectively blowing out 300 liters per minute of pressurized water of about 10 kg/cm$^2$ slantwise downward to the upstream side in the flow direction of the steel P to be rolled from above the steel P to the surface of the steel P so as to form an angle of 65° (or within the range from 50 to 80°) with the top of the steel P. The plurality of nozzles 8*a*, as shown in FIG. 3, are arranged at an interval in the length direction of the steel P to be rolled and at an interval also in the width direction thereof. The nozzles 8*a* blow out water so as to spread in the width direction of the steel P to be rolled, and the spread angle in the width direction of the steel P is preferably set to 15 to 30°, and the spread angle in the length direction is preferably set to 1 to 100 (respectively set to 21° and 3° in this embodiment).

By use of the water jet spray 8, cooling water put on the steel P by the operation of the cooling unit 7 can be smoothly removed, so that by various measuring instruments installed on the downstream side, various measurements concerning the steel P to be rolled after rolling, that is, the manufactured steel plate can be executed properly. In this case, water is heavier than gas, so that it can be easily given kinetic energy and can be easily obtained, thus water is suitable for a jet fluid. It is considered to be a reason for producing a good operation that by blowing out pressurized water slantwise downward to the upstream side, cooling water can be prevented from reaching the downstream side (the side of the measuring instruments) and furthermore by use of the nozzles spreading in the width direction of the steel P to be rolled, cooling water can be removed from the top of the steel P to be rolled in full width.

Additionally, for the work rolls of the mills of the respective stands, as shown in FIG. 3, jet nozzles (for example, numerals 5*i*, 5*j*, 6*i*, 6*j*) for roll cooling water and water draining plates (for example, numerals 5*g*, 5*h*, 6*g*, 6*h*) for removing cooling water by them are arranged.

Next, an embodiment that hot rolling is executed using the aforementioned hot rolling apparatus (FIG. 1) is indicated below.

With respect to steel having chemical components of C of 0.16%, Si of 0.22%, and Mn of 0.82% (no other significant amount of component is included), a steel plate with a thickness of 2.33 mm and a width of 730 mm was manufactured by the rolling apparatus shown in FIG. 1 under three kinds of conditions (Embodiments 1 to 3). Table 1-1 indicated below shows the pass schedule (rolling conditions) of Embodiment 1 and Table 1-2 shows the pass schedule of Embodiments 2 and 3. Further, Table 1-3 shows the use state of the curtain wall type coolers 7A, 7B, and 7C of Embodiments 1 to 3 and Table 1-4 shows the finishing temperature of the steel P to be rolled measured behind the mill 6 on the last stage of Embodiments 1 to 3. In the tables, "rough bar" indicates a rough rolling apparatus and "F1" to "F6" indicate the mills 1 to 6 of the first stand to the sixth stand. Further, the rolling speed is not specially limited and the rolling speed (for example, 7 to 9 m/s) commonly used in a general hot strip mill is adopted.

TABLE 1-1

Embodiment 1: Pass schedule (Cumulative strain = 0.65)

| | | Rough bar | F1 | F2 | F3 | F4 | F5 | F6 |
|---|---|---|---|---|---|---|---|---|
| Plate thickness | mm | 40 | 22.82 | 12.55 | 7.53 | 4.89 | 3.33 | 2.33 |
| Pressurization rate | % | | 43 | 45 | 40 | 35 | 32 | 30 |
| Strain | — | | 0.55 | 0.58 | 0.50 | 0.42 | 0.38 | 0.35 |
| Cumulative Strain | — | | | | | | | 0.65 |

TABLE 1-2

Embodiments 2, 3: Pass schedule (Cumulative strain = 0.92)

| | | Rough bar | F1 | F2 | F3 | F4 | F5 | F6 |
|---|---|---|---|---|---|---|---|---|
| Plate thickness | mm | 40 | 25.96 | 17.39 | 12.17 | 7.06 | 3.88 | 2.33 |
| Pressurization rate | % | | 35 | 33 | 30 | 42 | 45 | 40 |
| Strain | — | | 0.42 | 0.40 | 0.35 | 0.53 | 0.58 | 0.50 |
| Cumulative Strain | — | | | | | | | 0.92 |

TABLE 1-3

Cooling conditions (Curtain wall)

| Embodiment | F4 back surface | F5 back surface | F6 back surface |
|---|---|---|---|
| 1 | Not used | Not used | Used |
| 2 | Not used | Not used | Used |
| 3 | Used | Used | Used |

TABLE 1-4

Temperature conditions

| Embodiment | Finishing temperature, ° C. |
|---|---|
| 1 | 800~850 |
| 2 | 800~850 |
| 3 | 750~780 |

The ferrite particle diameter and mechanical properties of hot rolled plates obtained from Embodiments 1 to 3 are shown in Table 1-5. In Table 1-5, "TS" indicates tensile strength, "YP" a yielding point, and "EL" an elongation. Further, in Table 1-5, the main ones of the rolling conditions shown in Tables 1-1 to 1-3 are additionally recorded.

TABLE 1-5

Rolling conditions and mechanical characteristics

| Embodiment | Curtain Wall Cooling | Cumulative Strain | Ferrite particle diameter μm | TS kg/mm$^2$ | YP kg/mm$^2$ | EL % |
|---|---|---|---|---|---|---|
| 1 | F6 | 0.65 | 6~9 | 40~50 | 30~40 | 25~30 |
| 2 | F6 | 0.92 | 4~4.5 | 55~65 | 45~55 | 25~30 |
| 3 | F4, F5, F6 | 0.92 | 3.5~4 | 57~65 | 49~57 | 26~30 |

TS: Tensile strength, YP: Yielding point, EL: Elongation

As shown in Table 1-5, in Embodiments 2 and 3 that the cumulative strain ($\epsilon_c$ which is the aforementioned totalized value) is set to 0.92, a steel plate having a ferrite structure with a particle diameter of about 4 μm and superior mechanical properties can be obtained. In Embodiment 3 that the curtain wall type coolers 7A to 7C are used on the exit side (the back surface) of the 3 stands (F4 to F6) on the later stage, a steel plate having a ferrite particle diameter of about 4 μm or less and particularly superior mechanical properties is obtained.

Figure 4:
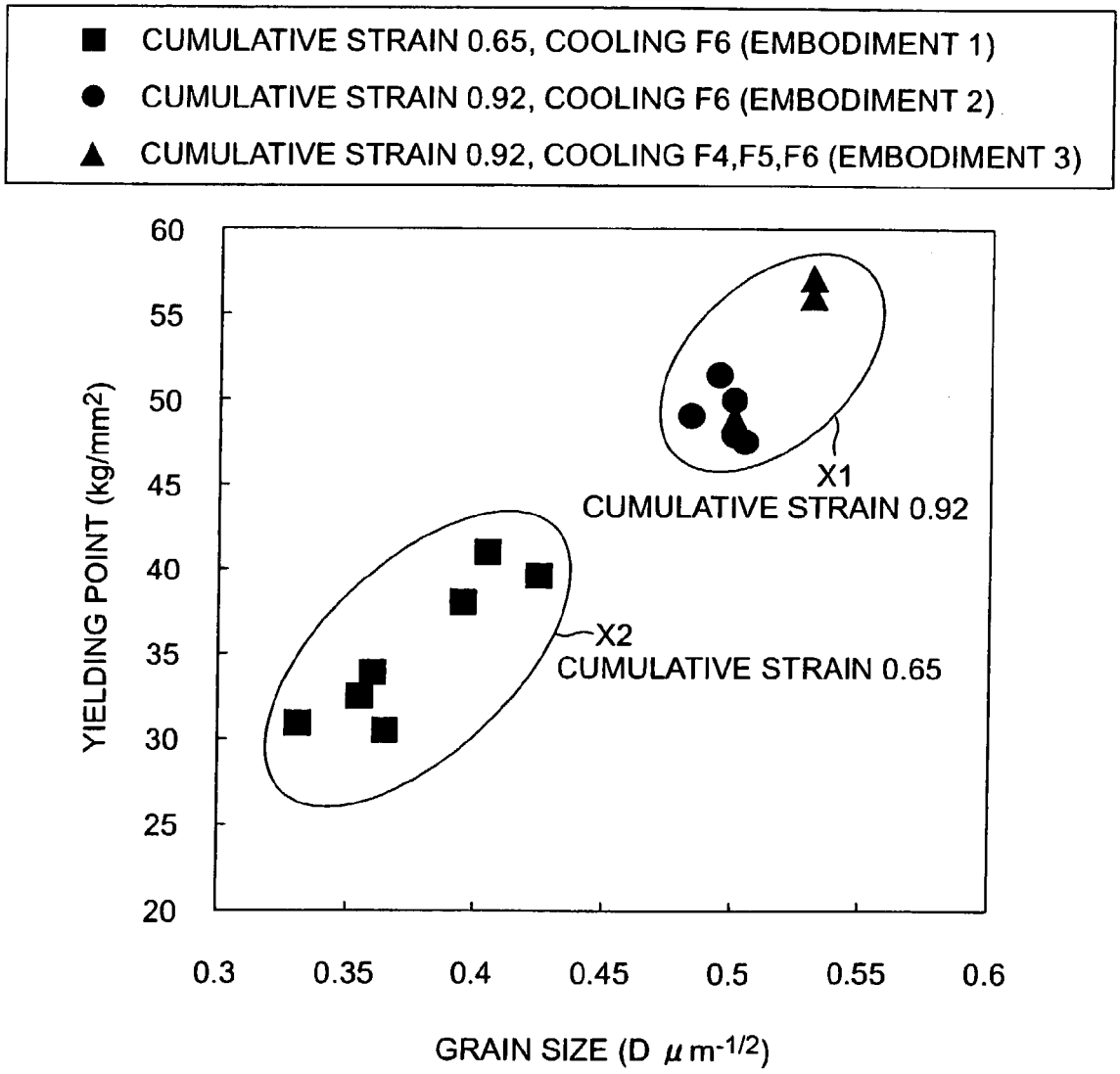
FIG. 4 is a chart showing the relation between the grain size concerning crystalline grains of the ferrite structure of steel plates manufactured using the rolling apparatus shown in FIG. 1 and the yielding point.

FIG. 4 is a drawing showing the relation between the grain size (the particle diameter D (μm) to the power of −½) concerning crystalline grains of the ferrite structure of steel plates obtained by Embodiments 1 to 3 and the yielding point. As shown in the drawing, when the cumulative strain of the mills of the 3 stands on the later stage is set to 0.65 (the group X2 shown in FIG. 4), the grain size is 0.43 or less (particle diameter of 5.4 μm or more) and the yielding point is not sufficient. However, when the cumulative strain is set to 0.92, the grain size becomes about 0.5 (particle diameter of about 4 μm) and the yielding point is increased to 45 kg/mm$^2$ or more.

Figure 5A:
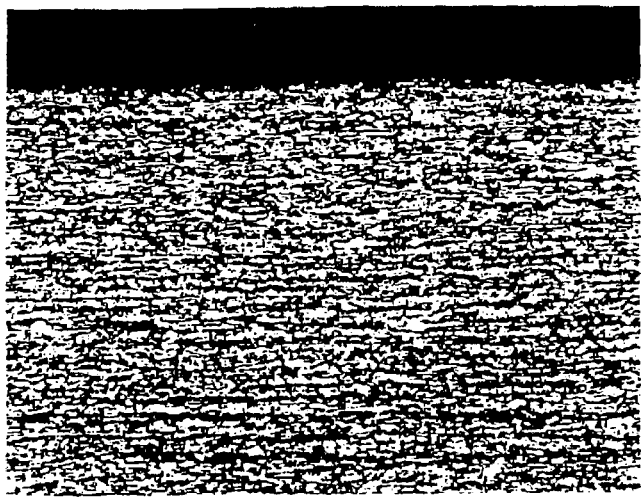
FIGS. 5A, 5B, and 5C are drawings showing the crystalline structure of steel plates manufactured using the rolling apparatus shown in FIG. 1 in the neighborhood of the top surface, the center of the plate thickness, and the bottom surface, respectively.
Figure 5B:
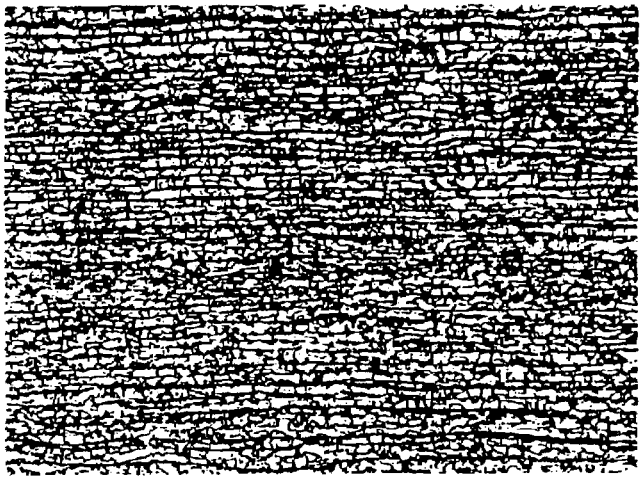
Figure 5C:
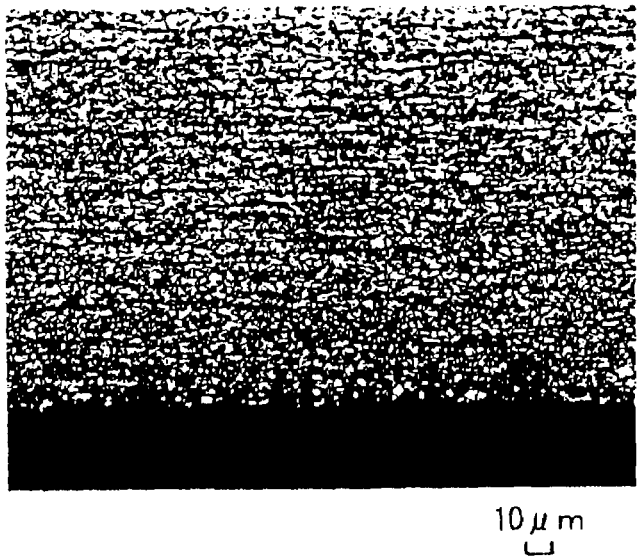

And, FIGS. 5A, 5B, and 5C are drawings showing the crystalline structures of the steel plate obtained in Embodiment 3 in the neighborhood of the top surface, the neighborhood of the center of the plate thickness, and the neighborhood of the bottom surface, respectively. At any part in the plate thickness, a fine ferrite structure with a particle diameter of 3 μm or so is formed.

As mentioned above, according to this embodiment, a hot rolled plate of fine-particle steel having a fine ferrite structure and a superior strength balance including the tensile strength, ductility, toughness, and fatigue strength can be manufactured smoothly and the steel plate can be produced commercially. The reasons are summarized as indicated below.

a) The different-diameter roll mills 4, 5, and 6 of the 2 stands or more arranged on the later stage or the minimum-diameter roll mills 4', 5', and 6', since the equivalent roll diameter or the both (pair) work roll diameters are small, can execute rolling under high pressure at a low rolling load, that is, at a high pressurization rate. The reason is that the rolling load producing the same pressurization rate is reduced as the work roll diameter is reduced and is almost proportional to the work roll diameter (refer to FIG. 6). The phenomenon that when the rolling load is reduced, rolling at a high pressurization rate cannot be executed due to the roll flatness is eliminated and additionally the flat deformation amount of the rolls is reduced, thus edge drops are reduced (refer to FIG. 7).

b) The curtain wall type coolers 7A, 7B, and 7C installed on the later stage suppress temperature rise due to working heat generation of the steel P to be rolled accompanying rolling at a high pressurization rate under condition of cumulative strain of 0.9 or more. The coolers 7A, 7B, and 7C cool the steel P strongly by a large amount of cooling water supplied as mentioned above, so that even when the steel P to be rolled is accelerated, the coolers can keep the steel P within the temperature range (for example, the $Ar_3$ transformation point to $Ar_3$+50° C.) suited to execute the high-pressure rolling method. By strongly cooling the steel P to be rolled immediately after rolling like this, the particle growth of the fine structure in the steel P to be rolled can be stopped and the diameter of crystalline grains of the ferrite structure in a manufactured steel plate is made finer such as about 4 μm or less. Since the coolers 7A, 7B, and 7C are arranged not only on the exit side of the mill 6 of the stand on the last stage but also on the exit side of the mills of at least 2 stands on the later stage, the coolers effectively take the heat generated during rolling by the mill 6 on the last stand and the mills of the preceding stands and keep the temperature properly. Since the coolers 7A, 7B, and 7C are arranged on the exit side of the mill of each stand, the steel P to be rolled immediately after rolling by the mill of each stand is strongly cooled and the operation of stopping the particle growth of the fine structure is ensured. Further, the coolers 7A, 7B, and 7C hit cooling water on the steel P to be rolled in full width, so that the steel P can be cooled uniformly without one-sided in the width direction.

As mentioned above, according to this embodiment, the aforementioned problems i) and ii) concerning execution of the high-pressure rolling method are solved and, by use of a rolling apparatus of a general hot strip mill type, a fine-particle steel plate can be manufactured smoothly and a fine-particle steel plate can be produced commercially.

Further, when the curtain wall type coolers 7A, 7B, and 7C are properly used so as to keep the temperature range of the steel P to be rolled between 700° C. and 800° C. (temperature zone), using steel containing Nb and Ti as steel P to be rolled, the aforementioned control rolling method can be executed stably (consequently a fine-particle steel plate can be manufactured).

Further, when steel to be rolled containing carbon of 0.5% or less and an alloy element of 5% or less is rolled, a fine-particle steel plate having such components can be widely used due to the balanced mechanical properties (general-purpose from the viewpoint of tensile strength and ductility) and high weldability, and be obtained easily due to a comparatively low price, and moreover has a good cyclic property, so that it is considered to be highly demanded. Therefore, for a steel plate having such component contents, the commercial contribution degree is high and sufficient economical rationality accompanies the production thereof.

Generally, when the amount of C (carbon) is increased, the ferrite amount is reduced and steel mainly composed of pearlite is obtained. However, according to this embodiment, even if the C amount is the same, the ferrite amount can be increased and when the C amount is not more than 0.5%, a structure mainly composed of ferrite can be obtained.

Further, this embodiment obtains good results regardless of existence of alloy elements other than C in the steel P to be rolled. However, to set the temperature range of $Ar_3$ transformation point to $Ar_3$+50° C. between 700° C. and 900° C. which is a most suitable temperature range for hot rolling, it is preferable to adjust the transformation point temperature depending on the total amount of alloy elements. However, when the total content of alloy elements is more than 5%, the $Ar_3$ transformation point becomes extremely low and fine particles cannot be easily obtained.

Next, a hot rolling apparatus and a hot rolling method by another embodiment of the present invention will be explained.

The hot rolling method by the aforementioned embodiment strongly pressurizes (that is, high pressurization at a cumulative strain of 0.9 or more) steel to be rolled mainly by the mills on the later stage, keeps the steel to be rolled at a proper temperature, thereby manufactures a fine-particle steel plate of high quality that the ferrite particle diameter is about 4 μm or less. To realize such a method, the hot rolling apparatus shown in FIG. 1 adopts a constitution for realizing necessary pressurization at a comparatively low rolling load and strongly cooling steel to be rolled. By doing this, if steel to be rolled is strongly cooled (temperature control) under sufficiently high pressure, by a rolling apparatus generally tandem, a hot rolled steel plate of fine-particle steel of extremely high quality can be produced industrially.

However, in the aforementioned embodiment, there is a room for improvement in respect of lightening the burden imposed on the equipment or running and manufacturing a hot rolled steel plate of fine-particle steel most effectively. Namely, by further study of the influence of the conditions of pressurization and cooling on the metallic structure of steel to be rolled, the reduction in the quality (ferrite particle diameter, etc.) is suppressed inasmuch as is possible, and the manufacturing conditions are relaxed, and a fine-particle steel plate can be manufactured at a low cost.

By improving the rolling method from such a flank of cost to effect, a fine-particle steel plate which is fully practical but is on a slightly low level of quality (particle diameter, etc.) can be easily produced commercially. If the high-level high pressurization explained in the aforementioned embodiment is always essential regardless of the quality of a steel plate, the production cost is increased in relation to the constitution of the rolling apparatus and consumption of the rolls and the cooling unit also requires a higher equipment cost and running cost due to working heat generation of steel to be rolled accompanying high pressurization.

The hot rolling apparatus and method according this embodiment solve those problems.

Figure 10:
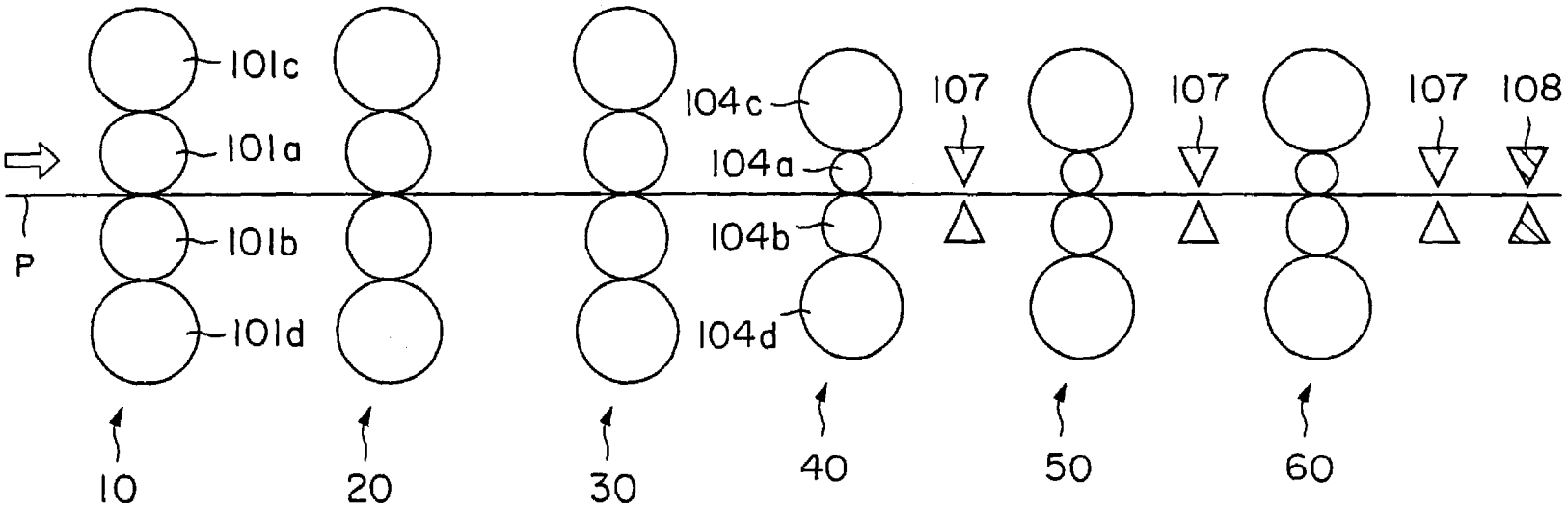
FIG. 10 is a side view conceptually showing the whole arrangement of a continuous hot rolling apparatus of another embodiment of the present invention.

The continuous hot rolling apparatus according to this embodiment shown in FIG. 10 is a so-called finishing rolling apparatus for the steel P to be rolled, and on the upstream side (not shown in the drawing) in the flow direction of the steel P to be rolled, a heating furnace and a rough rolling apparatus are installed, and on the downstream side (not shown in the drawing), a run-out table and a winder are arranged. The hot rolling apparatus is composed of mills 10 to 60 of 6 stands in total respectively having rolls which are arranged tandem, continuously rolls the steel P to be rolled roughly rolled on the upstream side, thereby generally manufactures various hot rolled plates with a thickness of about 2 to 16 mm. To smoothly execute the normal rolling for manufacturing a steel plate having a general internal structure (the mean ferrite particle diameter is 10 μm or more) and execute rolling of fine-particle steel by setting proper running conditions, that is, manufacture a hot rolled steel plate of fine-particle steel having a fine ferrite structure, the rolling apparatus shown in FIG. 10 is structured as indicated below.

Figure 11A:
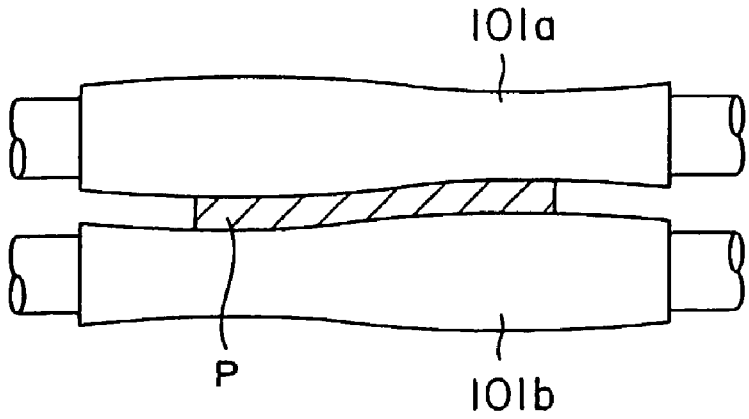
FIGS. 11A, 11B, and 11C are schematic views for explaining the CVC function regarding the mill 10 on the preceding stage in the rolling apparatus shown in FIG. 10.
Figure 11B:
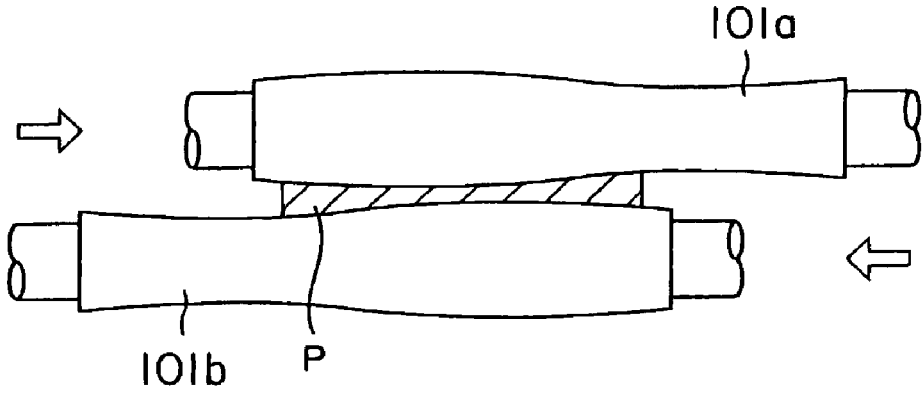
Figure 11C:
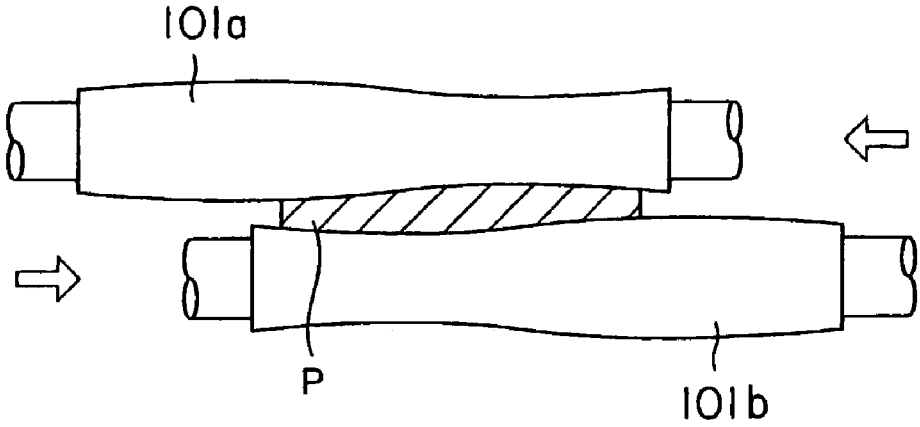

Firstly, as 3 stands on the preceding stage, the so-called CVC mills 10, 20, and 30 are arranged tandem. The CVC mill 10 positioned closest to the entrance side of the hot rolling apparatus is structured as a quadrupole mill composed of work rolls 101*a* and 101*b* and backup rolls 101*c* and 101*d* as shown in FIG. 10 and the work rolls 101*a* and 101*b* have crowns (CVC, that is, continuous diameter changes) as shown in FIG. 11A. The work rolls 101*a* and 101*b*, as shown in FIGS. 11B and 11C, can move (shift) in the long axial directions opposite to each other at the same time, thus the position relationship between the rolls, that is, the roll gap can be adjusted. The diameter of the work rolls 101*a* and 1*b* is set to 700 mm and the maximum shift amount is set to 100 mm in both forward and backward directions. The CVC mills 20 and 30 of the other two stands are not different from the CVC mill 10 in the constitution and function.

The reason that the CVC mills 10, 20, and 30 are arranged on the preceding stage like this is that the crown (shape) of the steel P to be rolled is to be kept suitably. In the different-diameter roll mills 40, 50, and 60, which will be described later, on the later stage, at the time of rolling fine-particle steel, thermal crowns caused by working heat generation due to rolling are easily formed, so that plate crowns are corrected beforehand by the CVC mills 10, 20, and 30 installed on the preceding stage and the medium drawing of the steel P to be rolled can be reduced. Respectively to the work rolls 110*a* and 101*b* of the CVC mills 10, 20, and 30, an AC motor (not shown in the drawing) with a variable speed control means attached is connected via a speed reducer and a universal coupling (both are not shown in the drawing).

As 3 stands on the subsequent later stage, the so-called different-diameter roll mills 40, 50, and 60 are arranged tandem. The stand intervals of all the 6 stands including the CVC mills 10, 20, and 30 aforementioned are all equal such as 5.5 m. The different-diameter roll mill 40 corresponding to the 4th stand counted from the CVC mill 10 is structured as a quadrupole mill composed of work rolls 104*a* and 104*b* and backup rolls 104*c* and 104*d* as shown in FIG. 10 and in this example, the work rolls 104*a* and 104*b* have different diameters. Among the work rolls 104*a* and 104*b*, only the lower roll 104*b* with a large diameter is driven to rotate by a motor (not shown in the drawing, an AC motor with a variable speed control means) connected via the speed reducer (not shown in the drawing) and the universal coupling and the upper roll 104*a* with a small diameter is structured so as to freely rotate free of driving force. The work rolls 104*a* and 104*b* are respectively provided with a bender (not shown in the drawing), so that the work rolls 104*a* and 104*b* can be provided with bending. Further, the work rolls 104*a* and 104*b* are given the CVC function and can be moved forward and backward in the long axial direction within a range of 100 mm. The diameter of the work roll 104*a* is 480 mm and the diameter of the work roll 104*b* is 600 mm, so that the equivalent roll diameter which is a mean value of the two is small such as 540 mm. In the constitution and function aforementioned, the different-diameter roll mills 50 and 60 of the other 2 stands positioned behind are not different from the different-diameter roll mill 40.

The equivalent roll diameter is small, and only one work roll 104*b* is driven, thus shearing force operates on the steel P to be rolled, so that the different-diameter roll mills 40, 50, and 60 of 3 stands can execute rolling at a high pressurization rate (for example, a pressurization rate of 50%) even at a comparatively low rolling load. Therefore, high-pressure rolling for rolling fine-particle steel can be executed extremely at a small rolling load and moreover, at that time, the rolling load is small, so that even for rolling a thin plate with a thickness of about 2 mm, faults due to the roll flatness and edge drops can be avoided.

To continuously execute rolling of fine-particle steel, it is necessary to sufficiently cool the steel P to be rolled and keep it within a proper temperature range, so that on each back and/or front of the mills 40, 50, and 60 of the stands on the last stage of the hot rolling apparatus, as shown in FIG. 10, curtain wall type coolers 107 (numerals 107A to 107H shown in FIG. 12) are arranged. The coolers 107 are cooling unit for flowing and hitting a large amount of cooling water at normal temperature (laminar flow, for example, numeral f shown in FIG. 12) in a curtain shape (curtain wall shape) toward the full-width surface of the steel P to be rolled from the headers installed above or below. The thickness of cooling water to flow in a curtain shape (curtain thickness) must be 10 mm or more and is preferably about 16 mm from the viewpoint of the cooling effect. The amount of cooling water of each cooler 107 can be adjusted within the range from 100 to 500 $m^3$/h per unit width (1 m) of the steel P to be rolled and the temperature lowering rate of the steel P to be rolled by cooling is set to 20° C./s or more. When strong pressurization is to be added, cooling water of 350 $m^3$/h per unit width is used. However, the temperature lowering rate of the steel P to be rolled at that time reaches 60 to 80° C./s (about 40° C./s including the temperature rise due to working heat generation) when the produce of plate thickness and speed is 1200 mm·mpm.

Figure 12:
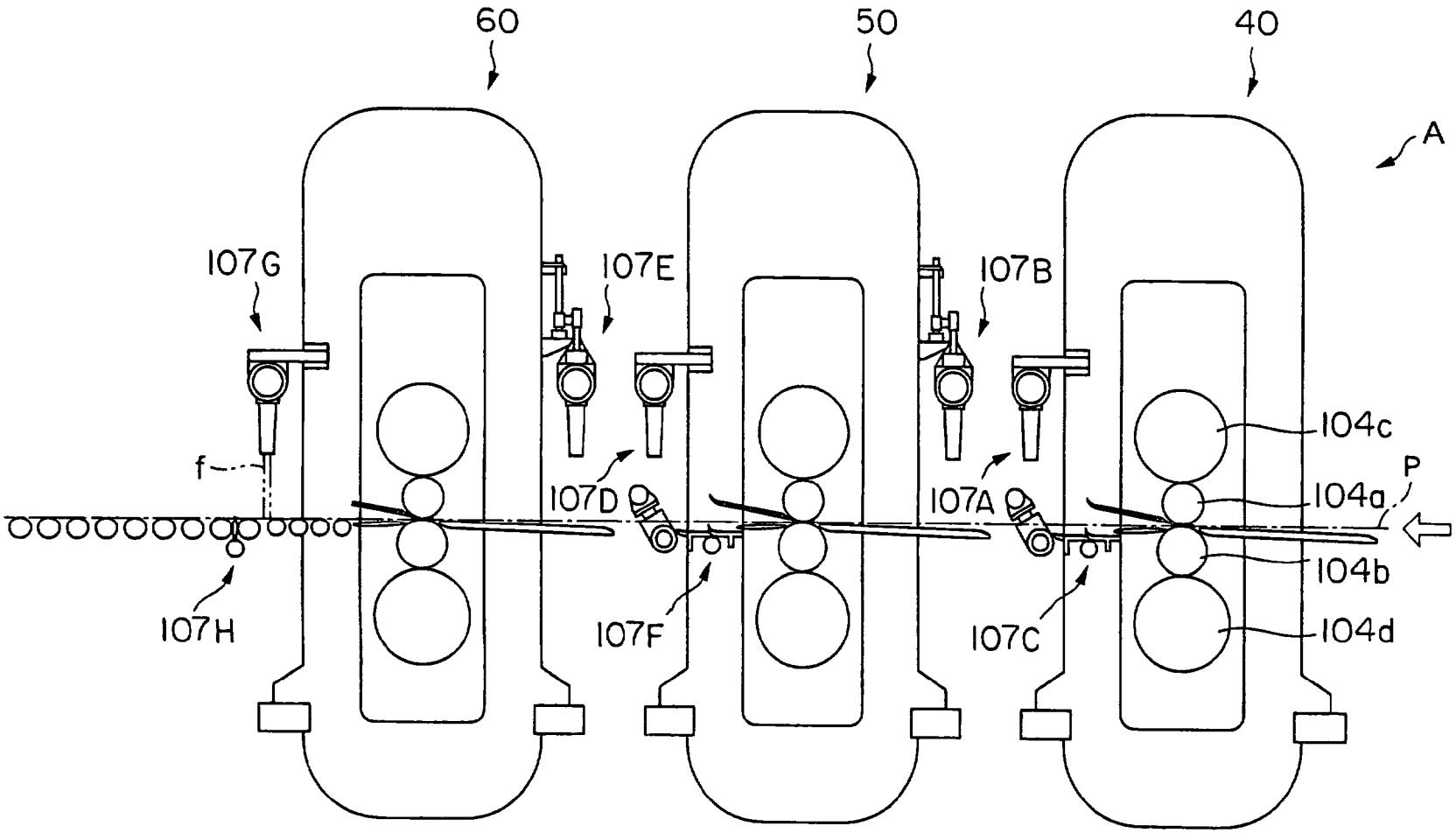
FIG. 12 is a side view showing the mills 40 to 60 on the last stage in the rolling apparatus shown in FIG. 10 and the neighborhood thereof in detail.

The plurality of coolers 107 shown in FIG. 10, as shown in FIG. 12, are arranged above and below the steel P to be rolled, and above the steel P to be rolled, the coolers 107A, 107B, 107D, 107E, and 107G are respectively arranged on the back of the mill 40, the front and back of the mill 50, and the front and back of the mill 60, and below the steel P to be rolled, the coolers 107C, 107F, and 107H are respectively arranged on the backs of the mills 40, 50, and 60. Among them, the cooler 107H is mounted to the frame of the roller table T on the back of the mill 60 on the last stage and the other coolers 107A to 107G are mounted to the housings of the respective stands.

By using the curtain wall type coolers 7 on each exit side of the mills 40, 50, and 60 of the 3 stands on the later stage, even when the high-pressure rolling method and control rolling method accompanied by remarkable working heat generation are to be executed using the hot rolling apparatus of this embodiment, the temperature rise of the mills 40, 50, and 60 is suppressed, and the steel P to be rolled is kept within a proper temperature range, and an occurrence of particle growth of the fine-particle structure can be suppressed after rolling. Further, even in a run-out table (not shown in the drawing) on the downstream side of the hot rolling apparatus shown in FIG. 10, the steel P to be rolled is cooled by cooling water so as to prevent particle growth.

Further, as shown in FIG. 10, in the hot rolling apparatus, on the exit side of the mill 60 which is a stand on the last stage and at a position on the downstream side by several hundreds mm to 1 m from the curtain wall type coolers (107G, 107H), a water jet spray 108 is arranged. The reason is that cooling water put on the surface of the steel P to be rolled is removed by the coolers 107G and 107H and from a plurality of nozzles (not shown in the drawing), to the surface of the steel P to be rolled, pressurized water is blown out slantwise downward to the upstream side in the flow direction of the steel P to be rolled from above the steel P to be rolled so as to spread also in the width direction of the steel P to be rolled. By use of the water jet spray 108, cooling water put on the steel P to be rolled by the operation of the cooling unit 107 can be smoothly removed, so that by various measuring instruments (thermometer, etc., not shown in the drawing) installed on the downstream side, various values (rolling end temperature, etc.) concerning the steel P to be rolled after rolling can be measured properly. When the measuring accuracy is high, the rolling conditions such as the rolling end temperature can be accurately controlled under control of the amount of cooling water.

By a thermometer installed at a position on the downstream side of the water jet spray 108 and on the downstream side by about 2 m from the mill 60 on the last stage, the rolling end temperature of the steel P is measured and by a calculation operation means (not shown in the drawing) receiving the measured results, the amount of cooling water of each curtain wall type cooler 107 (particularly the coolers 107E, 107G, and 107H holding the mill 60 on the last stage) is increased or decreased. The rolling end temperature is controlled by the feedback control and kept within a proper range.

In the continuous hot rolling apparatus structured as mentioned above, at a sufficient speed (for example, 7 to 9 m/s) to ensure good productivity, a good hot rolled steel plate of fine-particle steel with a thickness of about 2 to 6 mm can be produced. Concretely, by rolling so as to obtain a cumulative strain ($\epsilon_c$ which is the aforementioned totalized value) of 0.6 or more and strongly cooling by the curtain wall type coolers 107 on each back of the mills 40, 50, and 60 on the later stage, a preferable fine-particle steel plate with a mean ferrite particle diameter of about 3 to 7 μm can be produced by using steel having a low carbon content and alloy element content as steel to be rolled. Some fine-particle steel may have a short elongation and such a disadvantage can be removed. The embodiment which will be described later is an example thereof.

The reason that such good production is made possible is that in the stands on the later stage which strongly affect the metallic structure, by keeping the temperature of the steel P to be rolled in a proper range using the curtain wall type coolers 107 having high cooling capacity, rolling at a high-pressurization rate producing the aforementioned cumulative strain can be executed by the different-diameter roll mills 40, 50, and 60 with a small diameter. In the mills 40, 50, and 60, roll flatness and edge drops can be avoided and crowns can be controlled by the CVC function of the mills 10 to 60, so that also on the later stage where the steel plate is made thinner, meandering of the steel P to be rolled and changing of the shape can be suppressed. Therefore, in this embodiment, fine-particle steel can be rolled sufficiently and smoothly and a steel plate can be formed with high precision in shape.

That a preferable fine-particle steel plate can be produced under the aforementioned condition is made clear by the inventors from many tests and investigation which are executed by using the hot rolling apparatus shown in FIG. 10 and variously changing the degree of cooling the steel P to be rolled (rolling end temperature) and the degree of pressurization (cumulative strain). Results of such tests and investigation and date concerning an embodiment that a preferable fine-particle steel plate is obtained are indicated below.

Test rolling is executed by using the continuous hot rolling apparatus in this embodiment and variously changing the pass schedule and rolling end temperature for the steel kind (no other significant components included) shown in Table 2-1. However, in every case, the plate thickness on the exit side of the mill 60 on the last stage is 2 to 3 mm and the rolling speed is 8 to 9 m/s.

TABLE 2-1

| | Chemical components of steel (weight %) Transformation point (° C.) | | | |
|---|---|---|---|---|
| | C | Si | Mn | $Ar_3$ |
| Embodiment | 0.16 | 0.2 | 0.8 | 785 |

Figure 13:
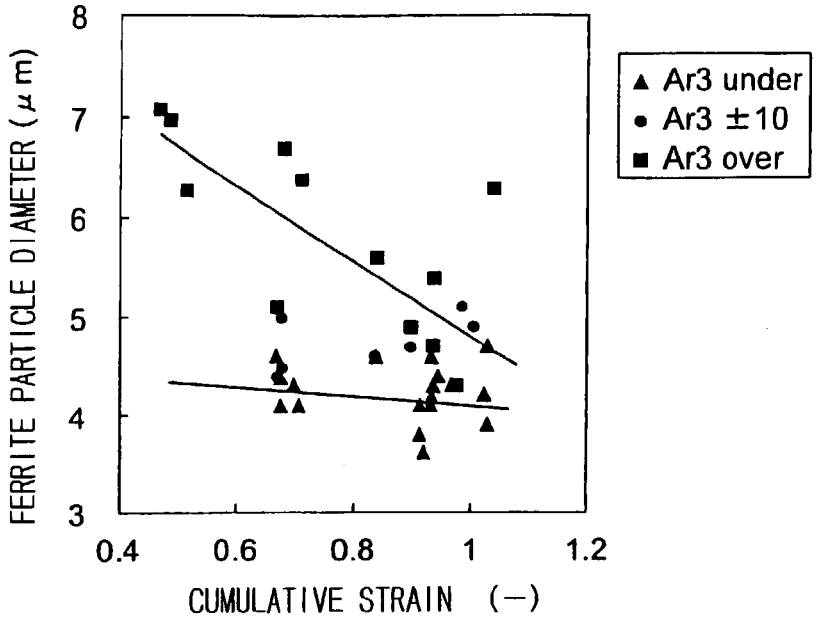
FIG. 13 is a chart showing the relation between the cumulative strain and the ferrite particle diameter of various steel plates obtained by test rolling.

For many steel plates obtained by the test rolling, the ferrite particle diameter at the center of the thickness is measured and the relation between the cumulative strain during rolling and the finishing temperature (rolling end temperature) is checked. The relation between the cumulative strain (transverse axis) and the ferrite particle diameter (ordinate axis) is indicated as shown in FIG. 13. In the drawing, symbol ● indicates data when the finishing temperature is within the range of $Ar_3$ transformation point ±10° C., and ▲ indicates data when the finishing temperature becomes lower than the $Ar_3$ transformation point −10° C., and ■ indicates data when the finishing temperature becomes higher than the $Ar_3$ transformation point +10° C. (FIGS. 13 to 17).

FIG. 13 shows that when the finishing temperature becomes higher than the $Ar_3$ transformation point +10° C., a tendency that the ferrite particle diameter reduces in accordance with the cumulative strain increases is seen slightly, while when the finishing temperature is other than it, even if the cumulative strain is increased, the ferrite particle diameter is little reduced.

Figure 14:
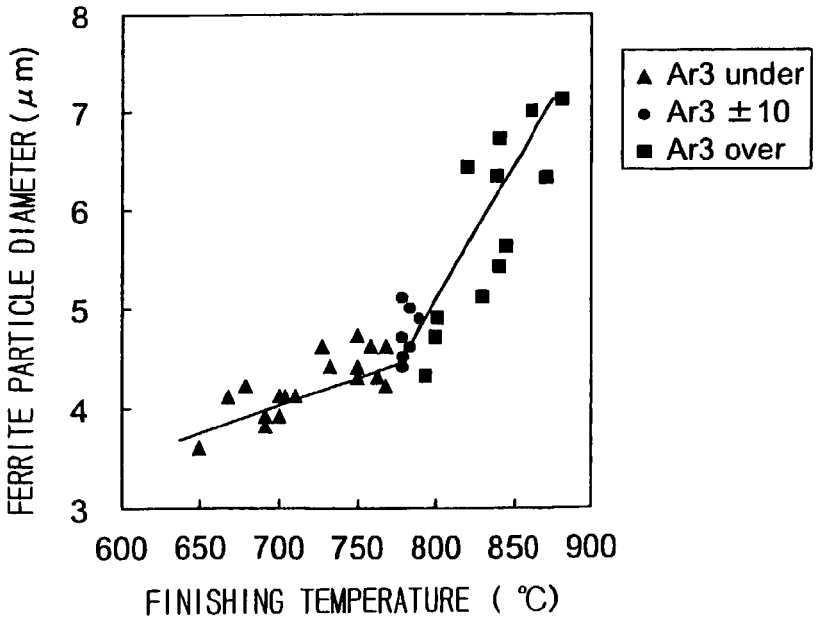
FIG. 14 is a chart showing the relation between the finishing temperature (rolling end temperature) and the ferrite particle diameter of various steel plates obtained by test rolling.

On the other hand, the relation between the finishing temperature (transverse axis) and the ferrite particle diameter (ordinate axis) is indicated in FIG. 14. FIG. 14 shows that as the finishing temperature lowers, the ferrite particle diameter is clearly reduced.

Figure 15:
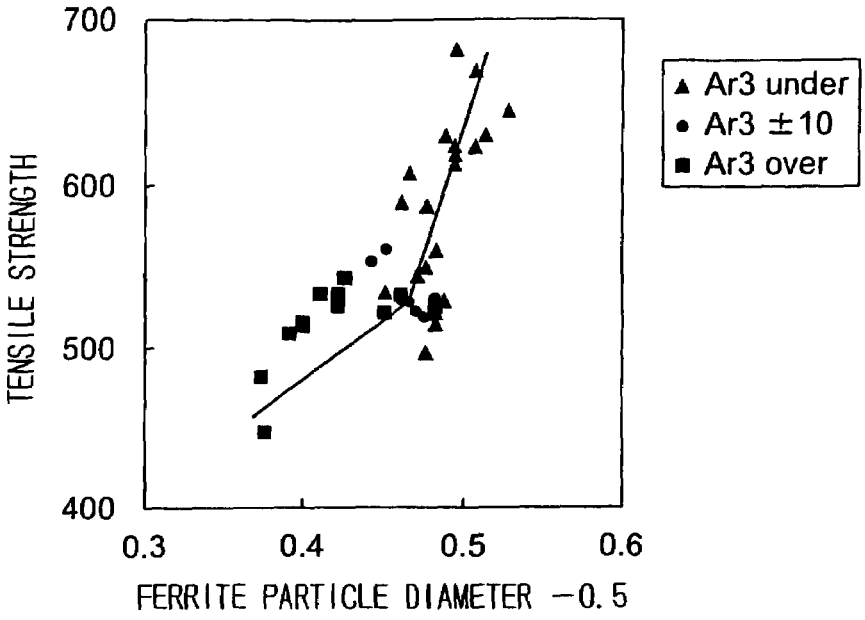
FIG. 15 is a chart showing the relation between the ferrite particle diameter and the tensile strength of various steel plates obtained by test rolling.
Figure 16:
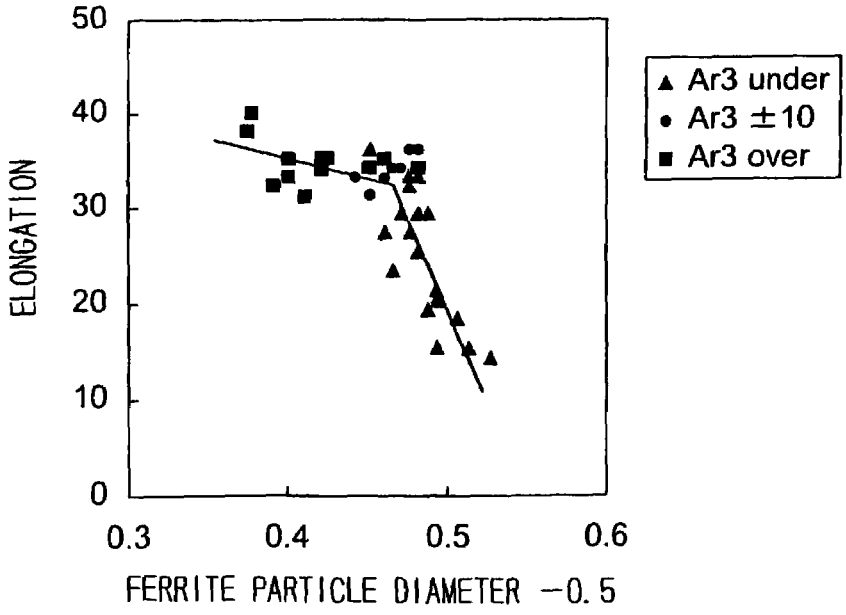
FIG. 16 is a chart showing the relation between the ferrite particle diameter and the elongation of various steel plates obtained by test rolling.
Figure 17:
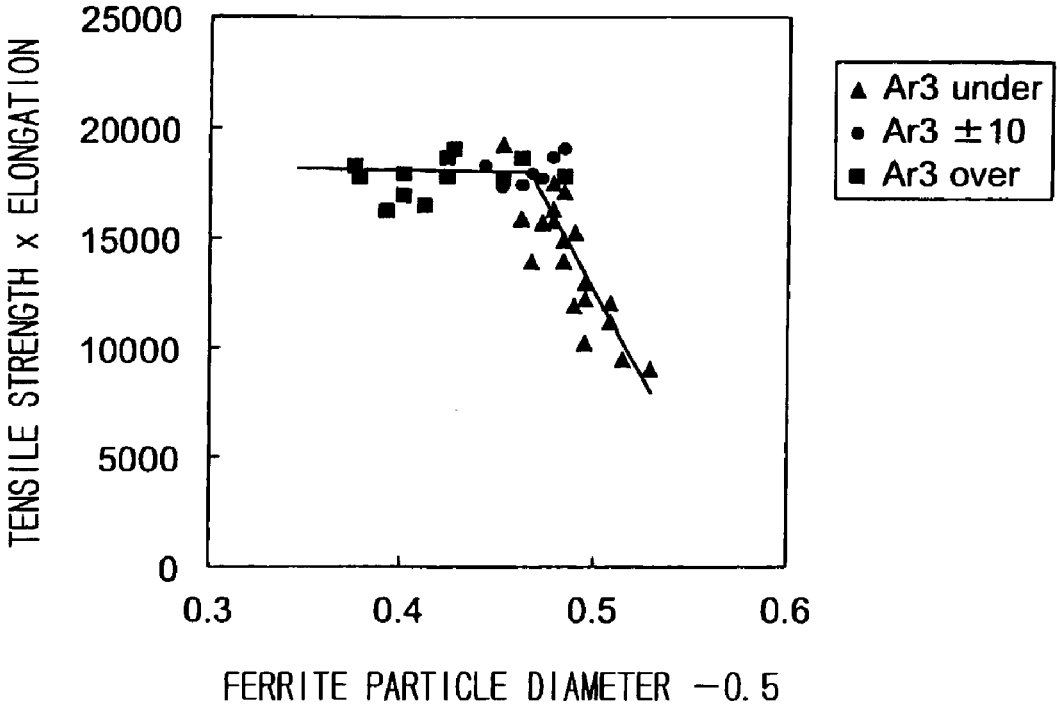
FIG. 17 is a chart showing the relation between the ferrite particle diameter and the tensile strength×elongation of various steel plates obtained by test rolling.

Further, in FIGS. 15 to 17 where the mechanical properties are checked for each manufactured steel plate and the results are related to the ferrite particle diameter and summarized, the transverse axis indicates a value of particle diameter (μm) to the power −½.

FIG. 15 shows the relation between the ferrite particle diameter and the tensile strength (MPa) and FIG. 16 shows the relation between the ferrite particle diameter and the elongation (%). The drawings show that as the ferrite particle diameter reduces (on the right of the transverse axis), the tensile strength is apt to increase, while when the finishing temperature becomes lower than the $Ar_3$ transformation point −10° C. (▼ in the drawing), as the ferrite particle diameter is refined, the elongation is reduced. The product (MPa×%) of tensile strength and elongation, as shown in FIG. 17, is also reduced as the ferrite particle diameter is refined when the finishing temperature is lower than the $Ar_3$ transformation point −10° C.

The following facts can be confirmed on the basis of these results. Namely:

a) To obtain a hot rolled steel plate of fine-particle steel with a small ferrite particle diameter by the rolling apparatus (FIG. 10) of this embodiment, setting of a lower finishing temperature is more effective than setting of a higher cumulative strain.

b) However, when the finishing temperature is extremely lower than the $Ar_3$ transformation point, the elongation is reduced even if the refinement is progressed, so that the advantage of strength is reduced.

c) In consideration of that when high pressurization is carried out so as to increase the cumulative strain, the cost is increased in relation to the constitution of the rolling apparatus and consumption of the rolls, it is preferable from the viewpoint of cost to effect to make the cumulative strain not so high, for example, 0.6 (preferably 0.65) or more and less than 0.9 and accurately control the finishing temperature, thereby obtain a fine-particle steel plate. By keeping the finishing temperature within the range of $Ar_3$ transformation point ±50° C., a fine-particle steel plate having a ferrite particle diameter of 4 to 6 μm and a superior mechanical strength balance can be produced. Particularly, to obtain a steel plate having a high tensile strength, in order to obtain a steel plate having a superior elongation by setting the finishing temperature, for example, within the range from $Ar_3$ transformation point −50° C. to $Ar_3$ transformation point +20° C., the finishing temperature is preferably set, for example, within the range from $Ar_3$ transformation point −20° C. to $Ar_3$ transformation point +50° C. However, from the viewpoint of the degree of each strength and the balance thereof, it is most preferable to keep the finishing temperature within the range of $Ar_3$ transformation point ±10° C.

The embodiments that good fine-particle steel plates are manufactured on the basis of the knowledge obtained in this way are introduced in Tables 2-2 to 2-4 and FIG. 18. Further, "F10" to "F60" shown in the tables respectively indicate the mills 10 to 60 of the first stand to the sixth stand.

Figure 18A:
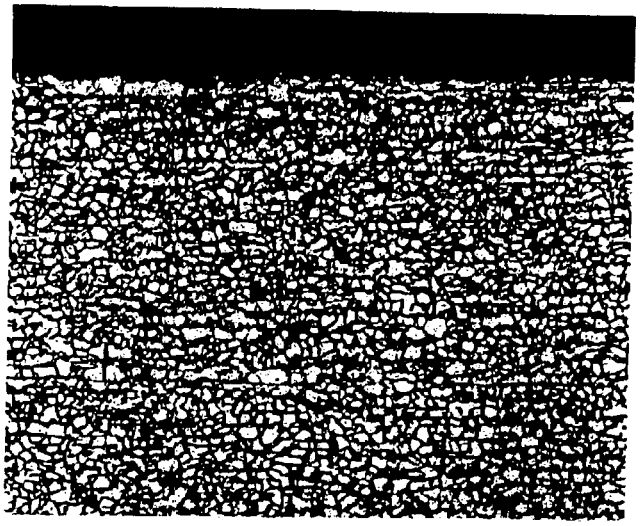
FIGS. 18A, 18B, and 18C are drawings showing the crystalline structure of steel plates obtained by the embodiment of the rolling method using the rolling apparatus shown in FIG. 10 in the neighborhood of the top surface, the neighborhood of the part inward from it by ¼ of the thickness, and the neighborhood of the center of the thickness, respectively.
Figure 18B:
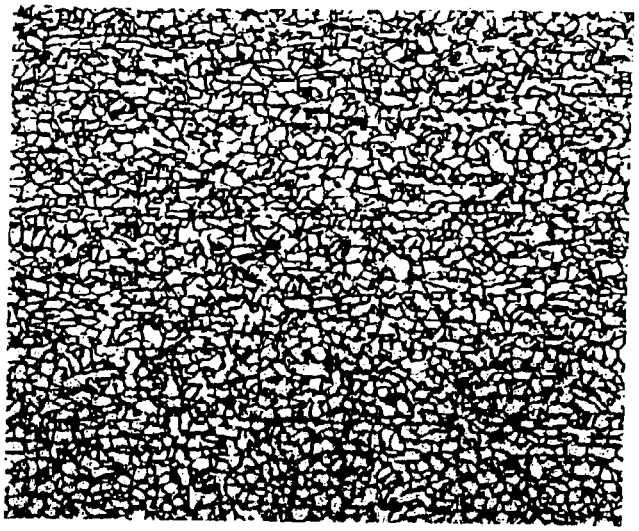
Figure 18C:
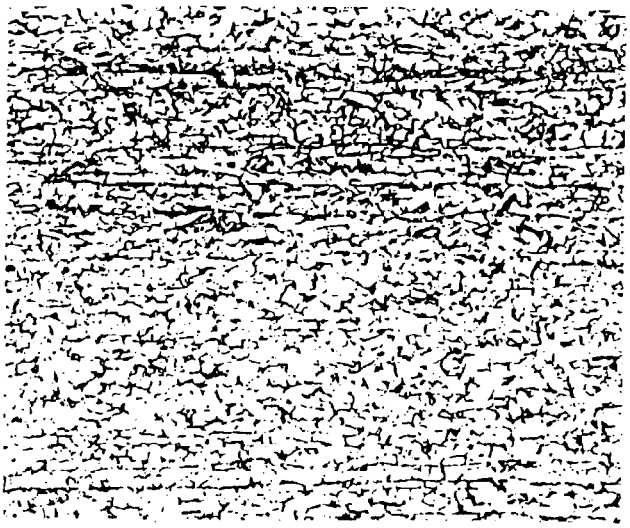

Table 2-2 shows the plate thickness ("Rough bar thickness" indicates the plate thickness on the exit side of the rough rolling apparatus), pressurization rate (%), strain, cumulative strain, and plate width on the exit side of each of the mills 10 to 60 and Table 2-3 shows the use state of each curtain wall type cooler 7 on the back of each of the mills 40 to 60 and the finishing temperature (rolling end temperature). Table 2-4 shows the ferrite particle diameter and mechanical properties of the steel plates of the embodiments obtained under the conditions shown in Tables 2-1 to 2-3 at the center of the plate thickness. And, FIGS. 18A, 18B, and 18C are drawings showing the crystalline structure of the steel plates of the embodiment in the neighborhood of the top surface, the position inward from it by ¼ of the thickness, and the center position of the thickness, respectively. At every part, a fine structure with a mean ferrite particle diameter of about 4 to 6 μm is formed.

Further, the rolling for obtaining the data shown in FIGS. 13 to 17 and the rolling in this embodiment are executed by the rolling apparatus (refer to FIGS. 10 to 12) of this embodiment. However, for rolling using a cumulative strain of about 0.6 to 0.9, it is inferred that there is no need to use the different-diameter roll mills 40 to 60 mentioned above as stands on the later stage. Namely, even if these mills have upper and lower work rolls having the same diameter such as about 600 to 700 mm, they are inferred to be enough. Further, if such a degree of cumulative strain is enough, a thermal crown accompanying working heat generation is expected not to be remarkable, so that the necessity of giving the CVC function and bending function to the mills 10 to 60 is considered to be low.

TABLE 2-2

| | | Embodiment | | | | | | | |
|---|---|---|---|---|---|---|---|---|---|
| | | Rough bar | F10 | F20 | F30 | F40 | F50 | F60 | Plate width mm |
| Plate thickness | mm | 40 | 22.28 | 13.19 | 7.78 | 4.52 | 2.85 | 2.07 | |
| Pressurization rate | % | | 44 | 41 | 41 | 42 | 37 | 28 | 670 |
| Strain | — | | 0.56 | 0.51 | 0.52 | 0.53 | 0.45 | 0.32 | |
| Cumulative strain | — | | | | | | | 0.68 | |

TABLE 2-3

| | Back surface of F40 | Back surface of F50 | Back surface of F60 | Finishing temperature ° C. |
|---|---|---|---|---|
| Embodiment | Used | Used | Used | 782 |

TABLE 2-4

| | Mechanical properties | | | |
|---|---|---|---|---|
| | Ferrite particle diam. μm | TS Mpa | YP Mpa | EL % |
| Embodiment | 4.5 | 519 | 431 | 34 |

TS: Tensile strength,
YP: Yielding point,
EL: Elongation

According to the continuous hot rolling method of this embodiment, a hot rolled steel plate of fine-particle steel having a sufficiently fine mean ferrite particle diameter, superior mechanical properties, and sufficiently high practical quality can be manufactured at an extremely low cost under a moderated condition.

Namely, by a process of effectively taking generated heat by working during rolling by the mills on the preceding and last stages and keeping a proper temperature (for example, keeping the rolling end temperature within the range of ±50° C. of the $Ar_3$ transformation point) by a) executing high pressurization such as a cumulative strain of 0.6 or more using mills of a plurality of stands and b) strongly cooling the steel P to be rolled on each exit side of a plurality of mills on the later stage and stopping particle growth of a fine structure, a hot rolled steel plate of fine-particle steel with a mean ferrite particle diameter of about 10 μm or less can be manufactured.

Obtaining of a fine-structure steel plate by this process is made clear by the latest investigation and study by the inventors. Namely, it is ascertained that among the high pressurization condition and strongly cooling condition for steel to be rolled, even if the former condition is slightly relaxed (that is, even if the cumulative strain is increased up to 0.9), a high-quality fine-particle steel plate with a ferrite particle diameter not so rough can be manufactured. Concretely, the mean ferrite particle diameter can be reduced to about 3 to 7 μm by the aforementioned cumulative strain and cooling.

When a cumulative strain of 0.6 or more is enough, the pressurization rate necessary to the mills, particularly the mills on the later stage is lowered considerably (about 30%) and the cost necessary to the equipment and running is greatly reduced. Therefore, a situation that the end of the steel P to be rolled is not fit well to any mill and slips is hardly caused.

Further, when the mean ferrite particle diameter is 10 μm or less, the fine-particle steel plate has mechanical properties particularly higher than those of a general (non-fine-particle steel) hot rolled steel plate having a particle diameter of more than 10 μm and can be expected to be widely used. Namely, in a fine-particle steel plate having the aforementioned chemical components and ferrite particle diameter, the mechanical property balance (general-purpose from the viewpoint of tensile strength, elongation, and ductility) is high and the weldability is superior. Therefore, the fine-particle steel plate is widely used, can be obtained easily due to a comparatively low price, and moreover has a good cyclic property, so that it is considered to be highly demanded. Therefore, in the rolling method of this embodiment for manufacturing such a steel plate, the commercial contribution degree is high and sufficient economical rationality accompanies the production thereof.

Next, the hot rolling method of another embodiment of the present invention will be explained.

The hot rolling method of this embodiment relates to the method for manufacturing a thick plate using the hot rolling apparatus of the aforementioned embodiment shown in FIG. 10.

In the hot rolling apparatus of the aforementioned embodiment shown in FIG. 10, in the CVC mills 10, 20, and 30 and the different-diameter roll mills 40, 50, and 60, in consideration of that as the rolling progresses, the plate thickness is reduced and the rolling speed is increased, the reduction ratio is reduced more for the mills on the later stage, and the maximum number of rotations of the work rolls is increased, and the maximum output torque is set low. The allowable maximum output torque values of the mills 10 to 60 are respectively 125.0, 98.2, 61.4, 34.1, 22.7, and 19.5 (the unit is ton (tf).m).

And, by use of all the mills 10 to 60 of the rolling apparatus of the aforementioned embodiment shown in FIG. 10 and at a sufficient speed (for example, 7 to 9 m/s) to ensure good productivity, a good hot rolled plate of fine-particle steel with a thickness of about 2 to 6 mm can be manufactured. Concretely, by rolling so as to obtain a cumulative strain ($\epsilon_c$ which is the aforementioned totalized value) of 0.6 or more and strongly cooling by the curtain wall type coolers 107 on each back of the mills 40, 50, and 60 on the later stage, a preferable fine-particle steel plate with a mean ferrite particle diameter of about 4 to 6 μm can be produced by using steel having a low carbon content and alloy element content as the steel P to be rolled. Particularly, when the cumulative strain is set to 0.9 or more, the mean ferrite particle diameter of the same steel kind can be reduced to 4 μm or less. The comparison example A which will be indicated later is an example (when $\epsilon_c$ 0.6) thereof. The reason that such production is made possible is that in the stands on the later stage which strongly affect the metallic structure, by keeping the temperature of the steel P to be rolled in a proper range using the curtain wall type coolers 107 having high cooling capacity, rolling at a high-pressurization rate producing the aforementioned cumulative strain can be executed by the different-diameter roll mills 40, 50, and 60 with a small diameter. In the mills 40, 50, and 60, roll flatness and edge drops can be avoided and crowns can be controlled by the CVC function of the mills 10 to 60, so that also on the later stage where the steel plate is made thinner, meandering of the steel P to be rolled and changing of the shape can be suppressed. This respect is also one of the reasons that such rolling of fine-particle steel is made possible.

However, when a thick fine-particle steel plate with a thickness of 6 mm or more instead of a thin plate is to be produced using up to the mill 60 on the last stage in the same way, the output torque is insufficient in the mill 60 on the last stage (or additionally the mill 50 on the preceding stage thereof) and the rolling may not be continued (the motor is stopped). The reason is that in a case of a thick plate, even when the pressurization rate is almost equal to (or smaller than) that of a thin plate, the contact arc length is longer than that of a thin plate, thus large rolling torque is necessary. In the mill 60 on the last stage and the mill 50 on the preceding stage, the allowable maximum output torque is small as mentioned above, so that the load becomes higher than the capacity, thus the rolling cannot be continued. Such a case is indicated in the comparison example B which will be described later.

The reason that the mills on the later stage cannot realize sufficient rolling torque can be explained as indicated below. Firstly, in the mills on the later stage, the roll driving system is under a high-speed specification so as to correspond to an increase in the rolling speed accompanying a decrease in the plate thickness due to progressing of rolling and as compared with the mills on the preceding stage, the mills on the later stage are generally set so that the rotational speed is high (that is, the reduction ratio is small) and the rolling torque is low. On the other hand, when a thick plate is to be rolled, even if the pressurization rate is the same as that at the time of rolling a thin plate, the contact arc length (contact length) on the entrance side is long (the contact angle is large), so that the necessary torque is considerably larger than that when a thin plate is rolled. Therefore, in the mills having low torque on the later stage, although a thin plate can be rolled smoothly, pressurization necessary for the equipment capacity is applied to the thick plate, so that it is apt to be difficult to manufacture a thick fine-particle steel plate.

Further, with respect to the aforementioned problem concerning manufacture of a thick fine-particle steel plate by a rolling apparatus that mills of a plurality of stands are arranged tandem, no documents indicating it are found. The art described in the patent publication referred in the present specification as a related art relates to manufacture of a thin fine-particle steel plate with a thickness of 3 mm or 5 mm or less or manufacture using a rolling apparatus of a reverse type.

Therefore, the inventors, to produce a thick fine-particle steel plate with a thickness of 6 mm or more using the continuous hot rolling apparatus of the aforementioned embodiment shown in FIG. 10, that is, a continuous hot rolling apparatus capable of manufacturing a thin fine-particle steel plate, operate the rolling apparatus in the states of a) to d) indicated below. Namely:

a) The mill 60 having small output torque on the last stage is not used. Even the preceding mills 40 and 50, when the allowable maximum output torque is smaller than required torque calculated from the plate thickness, pressurization rate, and deformation resistance, are not used. Therefore, from the mills 10 to 50 closer to the entrance side of the rolling apparatus than the mill 60 on the last stage, 3 or more stands satisfying the rolling torque are selected and used according to the pass schedule.

b) The pass schedule is decided so as to set the cumulative strain to 0.25 or more (preferably 0.29 or more) or set the pressurization rate by the mill on the last stage among the mills of 3 or more stands to be used to 12% or more (preferably 14% or more). The reason is that unless the rolling having strong power of influence on the metallic structure on the downstream side is executed at a pressurization rate which is constant or more, it is difficult to make the ferrite particle diameter smaller.

c) The steel plate is strongly cooled (so as to control the temperature lowering rate of the surface to about 40° C. per second) using the curtain wall type coolers 107. With respect to the coolers 107, the one immediately after the mill on the last stage among the mills to be used is used. All the coolers 107 (107A to 107H) including the cooler before the mill on the last stage are preferably used. The reason is that to make the ferrite particle diameter smaller, it is essential to sufficiently cool the steel P to be rolled immediately after rolling so as to keep it within a proper temperature range and exactly suppress the particle growth after rolling.

d) By the cooling c), the rolling end temperature (the surface temperature of the steel P to be rolled measured by a thermometer installed on the downstream side by several m from the mill 60 on the last stage) is controlled not to exceed the $Ar_3$ transformation point +50° C. (preferably the $Ar_3$ transformation point or lower). Although a preferable lower limit ought to exist, even if the surface temperature lowers considerably, the production of fine-particle steel is not impeded. The reason is inferred to be that as long as a steel plate with a thickness of 6 mm or more is rolled and manufactured at a speed of about 2 to 3 m/s, the temperature in the neighborhood of the center of the plate thickness of the steel P to be rolled is kept at about the $Ar_3$ transformation point regardless of the surface temperature.

By executing rolling as mentioned above, a thick hot rolled steel plate of fine-particle steel with a mean ferrite particle diameter of about 5 to 10 μm on the inside of the surface by ¼ of the thickness can be produced for the steel kind having a carbon content of 0.5% and an alloy element content of 5%. Data concerning production of such a thick steel plate is indicated below as Embodiments C and D.

Regarding the aforementioned production of thin and thick hot rolled steel plates of fine-particle steel by the continuous hot rolling apparatus, data concerning rolling are indicated below. In the tables, Comparison A, as described above, relates to production of thin (thickness of 2.07 mm) steel plates and Comparison B indicates an example that in production of thick steel plates using the mills 10 to 60, the rolling cannot be continued. And, Embodiments C and D indicate examples that thick (thickness of 12.2 mm) fine-particle steel plates are produced smoothly and continuously using the rolling apparatus.

Firstly, Table 3-1 indicates chemical components (no significant components other than the indicated ones are included) of steel plates and the temperature at the $Ar_3$ transformation point in the embodiments and Comparison examples A to D and Table 3-2 indicates the rolling end temperature (finishing temperature on the exit side), the plate width of each steel plate, and the use state of the curtain wall type coolers 107 on each back of the mills 40 to 60. Table 3-3 indicates the plate thickness on each exit side of the mills 10 to 60 ("Rough bar thickness" indicates the plate thickness on the exit side of the rough rolling apparatus). Tables 3-4, 3-5, and 3-6 indicate the pressurization rate (%), strain, cumulative strain, and required rolling torque (ton.m) of the mills 10 to 60 when the pass schedule in Table 3-3 is applied.

TABLE 3-1

Chemical components of steel (weight %) Transformation point

| Embodiment Comparison example | Component value C | Component value Si | Component value Mn | Component value P | $Ar_3$ [° C.] |
|---|---|---|---|---|---|
| Comparison A | 0.16 | 0.2 | 0.8 | 0.014 | 785 |
| Comparison B | 0.15 | 0.18 | 0.77 | 0.02 | 795 |
| Embodiment C | 0.17 | 0.21 | 0.8 | 0.014 | 785 |
| Embodiment D | 0.17 | 0.21 | 0.8 | 0.014 | 785 |

TABLE 3-2

Pass schedule Cooling condition (curtain wall)

| Embodiment Comparison example | Finishing temp. on exit side [° C.] | Flat width [mm] | Back surface of F40 | Back surface of F50 | Back surface of F60 |
|---|---|---|---|---|---|
| Comparison A | 782 | 670 | Used | Used | Used |
| Comparison B | 757 | 660 | Used | Used | Used |
| Embodiment C | 679 | 660 | Used | Used | Used |
| Embodiment D | 676 | 660 | Used | Used | Used |

TABLE 3-3

| Embodiment, Comparison example | Rough bar thickness | Plate thickness of F10 [mm] | Plate thickness of F20 [mm] | Plate thickness of F30 [mm] | Plate thickness of F40 [mm] | Plate thickness of F50 [mm] | Plate thickness of F60 [mm] |
|---|---|---|---|---|---|---|---|
| A | 40.0 | 22.28 | 13.19 | 7.78 | 4.52 | 2.85 | 2.07 |
| B | 39.8 | 39.8 | 31.1 | 24.5 | 19.2 | 15.0 | 12.2 |
| C | 32.2 | 21.2 | 16.6 | 14.1 | 12.2 | 12.2 | 12.2 |
| D | 36.1 | 23.4 | 18.2 | 15.4 | 12.2 | 12.2 | 12.2 |

TABLE 3-4

| Embodiment, Comparison example | Pressurization rate of F10 [%] | Pressurization rate of F20 [%] | Pressurization rate of F30 [%] | Pressurization rate of F40 [%] | Pressurization rate of F50 [%] | Pressurization rate of F60 [%] |
|---|---|---|---|---|---|---|
| Comparison A | 44 | 41 | 41 | 42 | 37 | 28 |
| Comparison B | | 22 | 21 | 22 | 22 | 19 |
| Embodiment C | 34 | 22 | 15 | 14 | | |
| Embodiment D | 35 | 22 | 15 | 21 | | |

TABLE 3-5

| Embodiment, Comparison example | Strain of F10 [−] | Strain of F20 [−] | Strain of F30 [−] | Strain of F40 [−] | Strain of F50 [−] | Strain of F60 [−] | Cumulative strain [−] |
|---|---|---|---|---|---|---|---|
| A | 0.56 | 0.51 | 0.52 | 0.53 | 0.45 | 0.32 | 0.68 |
| B | | 0.25 | 0.24 | 0.24 | 0.24 | 0.20 | 0.39 |
| C | 0.41 | 0.24 | 0.16 | 0.15 | | | 0.29 |
| D | 0.43 | 0.25 | 0.17 | 0.23 | | | 0.38 |

TABLE 3-6

| Embodiment, Comparison example | Rolling torque of F10 [ton · m] | Rolling torque of F20 [ton · m] | Rolling torque of F30 [ton · m] | Rolling torque of F40 [ton · m] | Rolling torque of F50 [ton · m] | Rolling torque of F60 [ton · m] |
|---|---|---|---|---|---|---|
| Comparison A | 112 | 59 | 48 | 31 | 19 | 16 |
| Comparison B | | 38 | 36 | 25 | 23 | 23 |
| Embodiment C | 73 | 28 | 14 | 18 | | |
| Embodiment D | 85 | 33 | 17 | 30 | | |

Table 3-6 shows that in Comparison example B that the rolling cannot be continued, the torque necessary to the mill 60 on the last stage is large such as 23 ton.m and it is larger than the aforementioned allowable maximum torque (19.5 ton.m) of the mill 60. Further, in Embodiment D, as shown in Table 3-5, stronger pressurization such as a cumulative strain of 0.38 is applied, so that it is found in Table 3-6 that in the mill 40 on the last stage among the mills used, large torque such as 30 ton.m (that is, torque not realized in the mill 50 or 60 on the later stage) is necessary.

Check results of the ferrite particle diameter and mechanical properties of steel plates produced in the embodiments and comparison examples A to D are shown in Table 3-7. However, in Comparison example B, data of steel plates obtained for a short time until the rolling is disabled are indicated. The indicated particle diameters are measured at the center of the thickness in Comparison example A and measured at the position inside the surface by ¼ of the thickness in Comparison example B and Embodiments C and D. In the table, "TS" indicates tensile strength, "YP" a yielding point, and "EL" an elongation and "L direction" means the length direction (rolling direction) and "C direction" the width direction. In all cases, it is found that a steel plate that the ferrite particle diameter is sufficiently small and the mechanical properties are excellent can be obtained.

TABLE 3-7

| Embodiment, Comparison example | Particle diam. in L dir. [μm] | Particle diam. in C dir. [μm] | Mechanical characteristics: TS in L direction [MPa] | YP in L direction [MPa] | EL in L direction [%] | TS in C direction [MPa] | YP in C direction [MPa] | EL in C direction [%] |
|---|---|---|---|---|---|---|---|---|
| A | 4.5 | 4.5 | 519 | 431 | 34 | 528 | 495 | 34 |
| B | 7.6 | 8.0 | 487 | 345 | 29 | 489 | 368 | 29 |
| C | 6.6 | 6.7 | 519 | 387 | 26 | 530 | 419 | 25 |
| D | 6.6 | 6.7 | 530 | 394 | 24 | 537 | 444 | 22 |

TS: tensile strength,
YP: yielding point,
EL: elongation

Figure 19A:
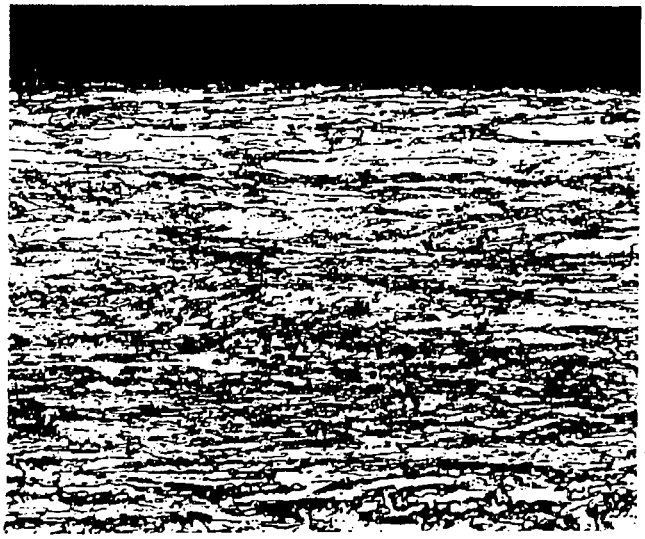
FIGS. 19A, 19B, and 19C are drawings showing the crystalline structure of steel plates obtained by the embodiment D of the present invention in the neighborhood of the top surface, the neighborhood of the part inward from it by ¼ of the thickness, and the neighborhood of the center of the thickness, respectively.
Figure 19B:
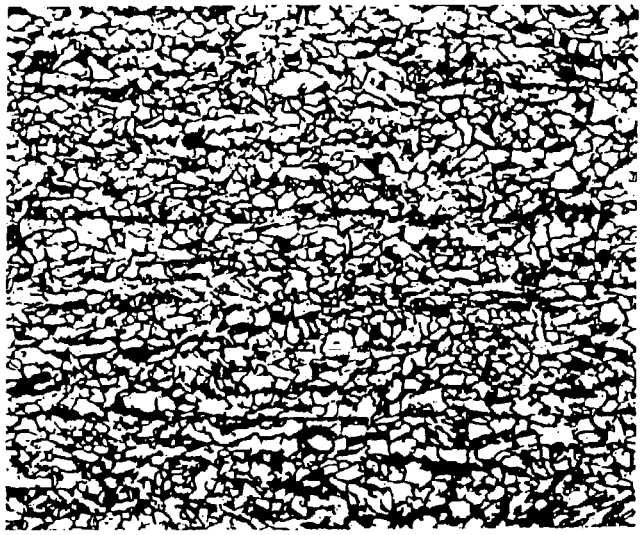
Figure 19C:
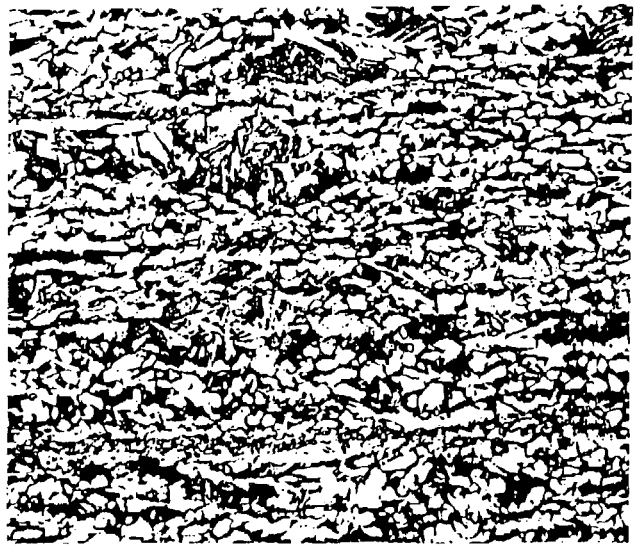

FIGS. 19A, 19B, and 19C are drawings showing the crystalline structure of steel plates obtained by the embodiment D in the neighborhood of the top surface, the position inward from it by ¼ of the thickness, and the central position of the thickness, respectively. In the position of ¼ of the thickness, a fine structure with a mean ferrite particle diameter of 5 to 10 μm is formed and at the center of the thickness, a fine structure with a mean ferrite particle diameter of 10 μm or less is formed.

Figure 20:
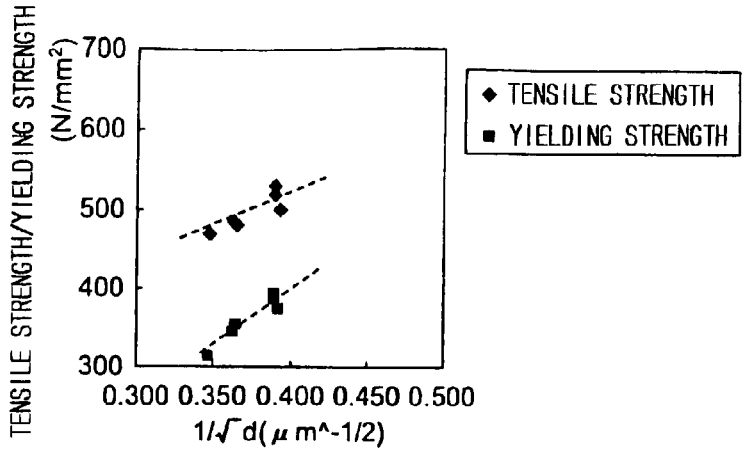
FIG. 20 is a chart showing the relation between the ferrite particle diameter, the tensile strength, and the yielding point of steel plates manufactured by the embodiment of the present invention.
Figure 21:
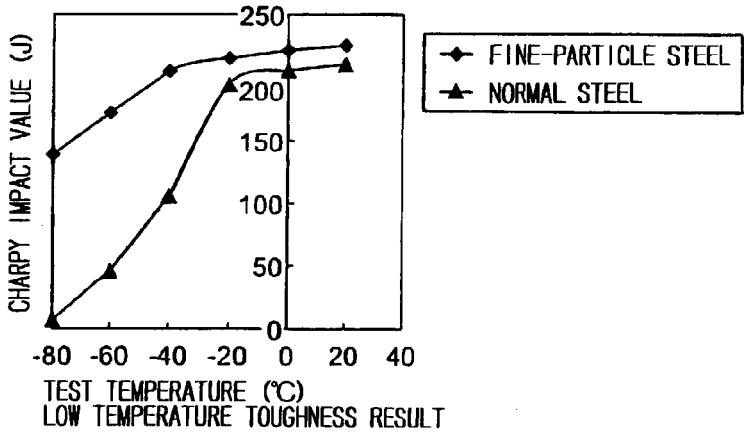
FIG. 21 is a chart showing temperature changes of the Charpy impact value of steel plates manufactured by the embodiment of the present invention and normal steel (non-fine particle steel plates).
Figure 22:
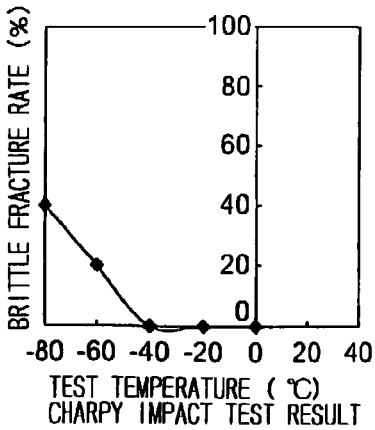
FIG. 22 is a chart showing temperature changes of the brittle fracture rate of steel plates manufactured by the embodiment of the present invention.

Further, FIGS. 20 to 22 show other mechanical properties of steel plates produced under the rolling condition of Embodiment D or similar to it which are checked and arranged. Namely, firstly, FIG. 20 is a drawing showing the relation between the ferrite particle diameter, the tensile strength, and the yielding point of a fine-particle steel plate (the transverse axis indicates a value of the ferrite particle diameter d (μm) to the power −½). And, for the same fine-particle steel plate, FIG. 21 shows temperature changes of the Charpy impact value together with changes of normal steel (non-fine particle steel plates) and FIG. 22 shows the temperature dependency of the brittle fracture rate. In addition, for the produced same steel plates, the welding coupling tensile test, coupling bending test, coupling impact test, micro test, and hardness distribution check test based on JIS Z 3040, "Check test method for welding method" are executed for a plurality of test samples and it is confirmed that the weldability of fine-particle steel plates is satisfactory.

As mentioned above, by the continuous hot rolling method of this embodiment, by using mills of a plurality of stands arranged so as to manufacture thin plates, thick fine-particle steel plates can be manufactured free of faults due to insufficient torque. The reason is that even when the mills on the later stage including the mill on the last stage become insufficient in torque, if those mills are not used and only the mills close to the entrance side of a rolling apparatus having a driving system capable of realizing high rolling torque under a so-called low speed specification are used, sufficient pressurization can be executed free of insufficient torque also in a case of rolling a thick plate with a long contact arc length. Although the rolling speed is not increased because the mill on the last stage is not used, there is an advantage that since the rolling speed becomes slow, the required time for cooling prolonged due to a thick plate can be easily ensured.

The reason that a thick plate of fine-particle steel can be rolled as mentioned above is that stronger pressurization such as a cumulative strain of 0.25 or more (or the pressurization rate at the mill on the last stage is 12% or more) is applied to the steel P to be rolled and on the exit side of the mill on the last stage among the mills used, the steel P is cooled for a sufficient time. As the aforementioned cooling on the exit side of the mill becomes stronger, fine-particle steel with a smaller ferrite particle diameter can be obtained. Further, in a sense of strengthening cooling, it is preferable to execute cooling also before the used mill on the last stage or execute cooling also on each exit side of a plurality of mills on the later stage.

The continuous hot rolling method of this embodiment is particularly characterized in that the rolling end temperature is set not to exceed the $Ar_3$ transformation point +50° C.

When the aforementioned cooling power is controlled and the rolling end temperature is set as mentioned above, at least in the neighborhood of the surface of a steel plate (for example, a steel plate having a carbon content of 0.5% or less and an alloy element content of 5% or less), a fine structure with a ferrite particle diameter of less than 10 μm is formed. The temperature range suited to the high-pressure rolling method is assumed to be from $Ar_3$ transformation point to $Ar_3$ transformation point +50° C. However, according to the test made by the inventors, it is enough that the rolling end temperature is within the range not exceeding the $Ar_3$ transformation point +50° C., as mentioned above. The reason is considered to be that, in a case of a thick plate, even if the surface temperature is low, the internal temperature is kept close to the $Ar_3$ transformation point.

Further, the continuous hot rolling method of this embodiment strongly cools the steel P to be rolled by the curtain wall type coolers 107, so that a fine-particle steel plate with a particle diameter which is particularly fine can be manufactured smoothly. Since uniform cooling can be realized, there is an advantage that the structure can be made uniform in full width of the steel plate.

The continuous hot rolling method of this embodiment is particularly characterized in that the steel P to be rolled having a carbon content of 0.5% or less and an alloy element content of 5% or less is rolled and a thick plate with a mean ferrite particle diameter of about 3 to 10 μm at the part inside the surface by ¼ of the thickness can be obtained.

A fine-particle steel plate having the chemical components and ferrite particle diameter mentioned above has a high mechanical property balance (general purpose from the viewpoint of tensile strength and ductility) and moreover low temperature brittleness and high weldability (for example, refer to FIGS. 20 to 22). Therefore, such a fine-particle steel plate is widely used, can be obtained easily due to a comparatively low price, and moreover has a good cyclic property, so that it is considered to be highly demanded. Therefore, for such a steel plate, the commercial contribution degree is high and sufficient economical rationality accompanies the production thereof.

The invention claimed is:

1. A hot rolling apparatus for rolling a steel to be rolled to manufacture a steel plate with a particle diameter of less than 5 μm, comprising:

a mill arranged on a preceding stage;

mills of at least two stands arranged on a later stage, said mills of at least two stands being selected from a list comprising different-diameter roll mills each including a pair of different-diameter work rolls having an equivalent roll diameter of less than 600 mm, one of said pair of different-diameter work rolls being directly driven, and minimum-diameter roll mills each including a pair of work rolls each having a diameter of less than 600 mm;

cooling units to cool said steel so that a particle growth in a micro-structure of said steel after being rolled can be suppressed, said cooling units being arranged on exit sides of said mills of at least two stands on said later stage, said at least two stands including a last stand on said later stage, one of said cooling units being positioned immediately downstream of the last stand on said later stage; and a fluid jet spray for jetting a fluid to said steel to be rolled and removing cooling water existing on said steel to be rolled, said fluid jet spray being arranged on a downstream side of said cooling unit in a flow direction of said steel to be rolled on an exit side of said mill of said stand on a last stage, wherein said fluid jet spray includes a plurality of nozzles for blowing out pressurized water toward said steel to be rolled so as to spread in a width direction of said steel to be rolled slantwise downward from above said steel to be rolled toward an upstream side in a flow direction of said steel to be rolled, and wherein said mill of said preceding stage and said mills of said later stage are configured such that a pressurization rate of said mills of said later stage is larger than a pressurization rate of said preceding stage.

2. A hot rolling apparatus according to claim 1, wherein said cooling unit is a curtain-wall type cooler.

3. A hot rolling apparatus according to claim 1, wherein among said mills arranged on said preceding stage and said later stage, at least said mill arranged on said preceding stage includes CVC mills of a plurality of stands.

4. A hot rolling apparatus according to claim 1, wherein said equivalent roll diameter is 550 mm or less.

5. A hot rolling apparatus according to claim 1, wherein work rolls selected from a list comprising said work rolls of said different-diameter roll mills and said work rolls of said minimum-diameter roll mills are provided with a CVC function and a bending function.

6. A hot rolling apparatus according to claim 1, further comprising a lubricant feed unit to feed a lubricant onto a roll surface of said mill, said lubricant feed unit being installed on said mill of at least any one stand among said mills arranged on said preceding stage and said later stage.

7. A hot rolling apparatus according to claim 6, wherein said lubricant feed unit feeds a lubricant containing a fine-particle solid lubricant in grease.

8. A fine-particle steel manufacturing method of rolling a steel to be rolled using a hot rolling apparatus, the hot rolling apparatus comprising:

a mill arranged on a preceding stage;

mills of at least two stands arranged on a later stage, said mills of at least two stands being selected from a list comprising different-diameter roll mills each including a pair of different-diameter work rolls having an equivalent roll diameter of less than 600 mm, one of said pair of different-diameter work rolls being directly driven, and minimum-diameter roll mills each including a pair of work rolls each having a diameter of less than 600 mm; and cooling units to cool said steel so that a particle growth in a micro-structure of said steel after being rolled can be suppressed, said cooling units being arranged on exit sides of said mills of at least two stands on said later stage, said at least two stands including a last stand on said later stage, one of said cooling units being positioned immediately downstream of the last stand on said later stage, wherein a pressurization rate of said mills of said later stage is larger than a pressurization rate of said preceding stage, the method comprising:

rolling said steel on said later stage of said rolling apparatus so that a cumulative strain on said steel becomes 0.9 or more; and suppressing a particle growth in a micro-structure of said steel after being rolled by cooling said steel with said cooling units so that said steel has a particle diameter of less than 5 μm.

9. A fine-particle steel manufacturing method according to claim 8, wherein said steel to be rolled immediately after leaving said mill of a last stand is cooled at a temperature lowering rate per second of 20° C. or more.

10. A fine-particle steel manufacturing method according to claim 8, wherein said steel to be rolled has a carbon content of 0.5% or less and an alloy element content of 5% or less.

* * * * *